US011117643B2

(12) United States Patent
Sakashita et al.

(10) Patent No.: US 11,117,643 B2
(45) Date of Patent: Sep. 14, 2021

(54) VESSEL PROPULSION SYSTEM AND VESSEL

(71) Applicant: YAMAHA HATSUDOKI KABUSHIKI KAISHA, Iwata (JP)

(72) Inventors: Yohei Sakashita, Iwata (JP); Makoto Ito, Iwata (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 0 days.

(21) Appl. No.: 16/837,928

(22) Filed: Apr. 1, 2020

(65) Prior Publication Data

US 2020/0331578 A1 Oct. 22, 2020

(30) Foreign Application Priority Data

Apr. 2, 2019 (JP) ..... JP2019-070880

(51) Int. Cl.

| | |
|---|---|
| ***B63H 25/42*** | (2006.01) |
| ***B63H 5/08*** | (2006.01) |
| ***B63H 5/125*** | (2006.01) |
| *B63H 21/17* | (2006.01) |
| *B63H 20/00* | (2006.01) |

(52) U.S. Cl.

CPC ..... *B63H 25/42* (2013.01); *B63H 5/08* (2013.01); *B63H 5/125* (2013.01); *B63H 21/17* (2013.01); *B63H 2020/003* (2013.01); *B63H 2025/425* (2013.01)

(58) Field of Classification Search

CPC ..... B63H 25/42; B63H 5/08; B63H 5/125; B63H 21/17; B63H 2020/003; B63H 2025/425

See application file for complete search history.

(56) References Cited

U.S. PATENT DOCUMENTS

| | | | | |
|---|---|---|---|---|
| RE39,032 | E | 3/2006 | Gonring et al. | |
| 8,170,734 | B2 * | 5/2012 | Kaji | B63H 25/02 701/21 |
| 8,170,735 | B2 | 5/2012 | Kaji | |
| 9,126,667 | B2 | 9/2015 | Mizutani | |
| 2003/0079668 | A1 * | 5/2003 | Morvillo | B63H 11/11 114/151 |
| 2008/0254689 | A1 * | 10/2008 | Kaji | B63H 25/02 440/1 |
| 2010/0174450 | A1 * | 7/2010 | Mizushima | B63J 3/02 701/36 |
| 2012/0093668 | A1 | 4/2012 | Gieras et al. | |
| 2016/0090166 | A1 | 3/2016 | Suzuki et al. | |

(Continued)

FOREIGN PATENT DOCUMENTS

| | | | |
|---|---|---|---|
| EP | 1364870 | A1 | 11/2003 |
| EP | 3000718 | A1 | 3/2016 |
| JP | 5371401 | B2 | 12/2013 |

(Continued)

*Primary Examiner* — Stephen P Avila

(74) *Attorney, Agent, or Firm* — Rabin & Berdo, P.C.

(57) ABSTRACT

A vessel propulsion system includes a bow thruster located at a bow of a hull, an outboard motor located on the hull and provided separately from the bow thruster, and a navigation controller. The navigation controller controls at least one of the bow thruster and the outboard motor in accordance with a state of at least one other of the bow thruster and the outboard motor.

18 Claims, 18 Drawing Sheets

(56) References Cited

U.S. PATENT DOCUMENTS

| | | | | |
|---|---|---|---|---|
| 2016/0096611 | A1* | 4/2016 | Suzuki ..... | B63H 25/42<br>701/2 |
| 2019/0061900 | A1 | 2/2019 | Hayashi et al. | |

FOREIGN PATENT DOCUMENTS

| | | | |
|---|---|---|---|
| JP | 5481059 | B2 | 4/2014 |
| JP | 2016-068610 | A | 5/2016 |
| JP | 2016-074250 | A | 5/2016 |
| JP | 5982716 | B2 | 8/2016 |
| JP | 2017-128166 | A | 7/2017 |

* cited by examiner

VESSEL PROPULSION SYSTEM AND VESSEL

CROSS REFERENCE TO RELATED APPLICATIONS

This application claims the benefit of priority to Japanese Patent Application No. 2019-070880 filed on Apr. 2, 2019, the entire contents of which are hereby incorporated herein by reference.

BACKGROUND OF THE INVENTION

1. Field of the Invention

The present invention relates to a vessel propulsion system, and relates to a vessel that includes the propulsion system.

2. Description of the Related Art

Japanese Patent No. 5481059 discloses a vessel that is provided with a hull, a bow thruster attached near a bow of the hull, an outboard motor attached to a stern of the hull, and a navigation controller. A vessel operation seat of the hull is provided with a lever that is tilted by a vessel operator and a knob that is disposed at a head portion of the lever and that is rotationally operated by the vessel operator. The bow thruster includes an electric motor, an electronic control unit (ECU) that controls the rotation direction and the rotation speed of the electric motor, and a propeller that is rotationally driven by the electric motor. The propeller that is rotating generates a thrust in a right-left direction that intersects a center line passing through the bow and through the stern in the hull.

The outboard motor includes a propulsion unit that is rotatable around a steering shaft and an electronic control unit. The propulsion unit includes an engine and a propeller that generates a thrust by being rotationally driven by the engine. An azimuthal angle (steering angle), which is an angle made by the direction of the thrust of the propulsion unit with respect to the center line of the hull, changes in accordance with the rotation of the propulsion unit. The electronic control unit of the outboard motor controls a shift position, a steering angle, and an engine rotation speed of the propulsion unit.

When the vessel operator tilts the lever or rotationally operates the knob, a signal that indicates a tilt amount of the lever or a signal that indicates a rotational operation amount of the knob is input into the navigation controller. In accordance with this signal, the navigation controller sets a target rotation direction and a target rotation speed of the electric motor, and gives these target values to the electronic control unit of the bow thruster, or sets a target shift position, a target steering angle, and a target engine rotation speed, and gives these target values to the electronic control unit of the outboard motor.

A generally-used bow thruster is a propulsion apparatus formed of an electric motor. However, the bow thruster that uses, for example, a DC (Direct Current) motor as a driving source is unsuitable to continue to generate a desired thrust for a long time. On the other hand, the outboard motor is capable of continuing to generate a desired thrust for a long time as long as there is engine fuel.

As thus described, the bow thruster and the outboard motor have mutually different thrust characteristics. In a vessel propulsion system that includes a bow thruster and a propulsion apparatus differing from the bow thruster as in Japanese Patent No. 5481059, consideration is not given to a difference in thrust characteristics between the bow thruster and the propulsion apparatus differing from the bow thruster, and therefore, if consideration is given to this difference, improvements to bring a hull behavior close to the intention of a vessel operator can be expected.

SUMMARY OF THE INVENTION

In order to overcome the previously unrecognized and unsolved challenges described above, one embodiment of the present invention provides a vessel propulsion system that includes a bow thruster designed to be disposed at a bow of a hull, a propulsion apparatus that is designed to be disposed at the hull and that differs from the bow thruster, and a cooperative control unit. In accordance with a state of at least one of the bow thruster and the propulsion apparatus, the cooperative control unit controls at least one other of the bow thruster and the propulsion apparatus. This state includes, for example, information relative to thrust characteristics of the bow thruster.

According to this arrangement, in accordance with a state of at least one of the bow thruster and the propulsion apparatus, at least one other of the bow thruster and the propulsion apparatus is controlled by the cooperative control unit, and therefore it is possible to allow the bow thruster and the propulsion apparatus to cooperate with each other. Therefore, it is possible to bring one of the bow thruster and the propulsion apparatus into operation so as to assist the other one even if, for example, the bow thruster and the outboard motor have mutually-different thrust characteristics. Hence, it is possible to bring a hull behavior close to the vessel operator's intentions.

In one embodiment of the present invention, the cooperative control unit controls a thrust generated by the propulsion apparatus in accordance with a state of the bow thruster.

This arrangement makes it possible to perform control so that, for example, the propulsion apparatus generates a thrust so as to assist the bow thruster. As a result, it is possible for the vessel propulsion system to generate a thrust desired by the vessel operator even if the state of the bow thruster changes. Therefore, it is possible to bring a hull behavior close to the vessel operator's intentions.

In one embodiment of the present invention, the propulsion apparatus includes a turning unit that changes a direction of the thrust with respect to the hull. The cooperative control unit controls the turning unit in accordance with a state of the bow thruster.

This arrangement makes it possible to change the direction of the thrust of the propulsion apparatus so as to assist the bow thruster, for example, by allowing the cooperative control unit to control the turning unit. This enables the vessel propulsion system to generate a thrust having a direction desired by the vessel operator even if the state of the bow thruster changes. Therefore, it is possible to bring a hull behavior close to the vessel operator's intentions.

In one embodiment of the present invention, the cooperative control unit obtains a state value that affects thrust characteristics of the bow thruster, and controls the propulsion apparatus in accordance with the state value.

According to this arrangement, for example, the propulsion apparatus is capable of performing control so as to generate a thrust according to the state value of the bow thruster so as to assist the bow thruster. This enables the vessel propulsion system to generate a thrust desired by the vessel operator even if the state value of the bow thruster changes in accordance with a change in the state of the bow thruster. Therefore, it is possible to bring a hull behavior close to the vessel operator's intentions.

In one embodiment of the present invention, the bow thruster includes an electric motor and a propeller driven by the electric motor. The state value includes a temperature of the electric motor.

This arrangement enables, for example, the propulsion apparatus to perform control so as to generate a thrust according to the temperature of the electric motor of the bow thruster so as to assist the bow thruster. This enables the vessel propulsion system to generate a thrust desired by the vessel operator even if the temperature of the electric motor changes in accordance with a change in the state of the bow thruster. Therefore, it is possible to bring a hull behavior close to the vessel operator's intentions.

In one embodiment of the present invention, the bow thruster includes an electric motor that is driven by electric power from a battery mounted on the hull and a propeller that is driven by the electric motor. The state value includes at least one of a voltage of the battery, an electric current of the battery, and a remaining amount of the battery.

This arrangement enables, for example, the propulsion apparatus to generate a thrust according to at least any one of the voltage of the battery, the electric current of the battery, and the remaining amount of the battery (i.e., information on the remaining capacity of the battery) so as to assist the bow thruster. The electric current of the battery is information on the consumption capacity of the battery, and the remaining amount of the battery is exactly the remaining capacity of the battery. In this case, it is possible for the vessel propulsion system to generate a thrust desired by the vessel operator even if the remaining capacity of the battery changes in accordance with a change in the state of the bow thruster. Therefore, it is possible to bring a hull behavior close to the vessel operator's intentions.

In one embodiment of the present invention, the bow thruster includes an electric motor that is driven by electric power from a battery mounted on the hull and a propeller that is driven by the electric motor. The state value includes a driving time of the electric motor.

This arrangement enables, for example, the propulsion apparatus to generate a thrust according to driving time of the electric motor so as to assist the bow thruster. The driving time of the electric motor is information on the consumption capacity of the battery, and it is possible to estimate the remaining capacity of the battery or the temperature of the electric motor from the driving time of the electric motor. In this case, it is possible for the vessel propulsion system to generate a thrust desired by the vessel operator even if the state of the bow thruster changes in accordance with a change in the remaining capacity of the battery. Therefore, it is possible to bring a hull behavior close to the vessel operator's intentions.

In one embodiment of the present invention, the cooperative control unit controls a thrust generated by the bow thruster in accordance with a state of the propulsion apparatus.

According to this arrangement, a thrust is generated so that the bow thruster assists the propulsion apparatus, and, as a result, it is possible for the vessel propulsion system to generate a thrust desired by the vessel operator even if the state of the propulsion apparatus changes. Therefore, it is possible to bring a hull behavior close to the vessel operator's intentions.

In one embodiment of the present invention, the vessel propulsion system additionally includes an operation element that is operated by a vessel operator in order to indicate a magnitude and a direction of a thrust that should be applied to the hull. The cooperative control unit controls the propulsion apparatus to generate a thrust having a fixed magnitude, and controls the thrust of the bow thruster in accordance with a command indicated by the operation element and in accordance with the thrust having the fixed magnitude generated by the propulsion apparatus.

According to this arrangement, when the vessel operator operates the operation element, the bow thruster generates a thrust so as to assist the propulsion apparatus controlled to generate the thrust having the fixed magnitude. This enables the vessel propulsion system to generate a thrust having a magnitude and a direction both of which are desired by the vessel operator who operates the operation element. Therefore, it is possible to bring a hull behavior close to the vessel operator's intentions.

In one embodiment of the present invention, the bow thruster is designed to be disposed in a state in which a thrust having a fixed direction is applied to the hull.

According to this arrangement, cooperation is performed between the bow thruster disposed to apply a thrust in the fixed direction to the hull and the propulsion apparatus, thus enabling the vessel propulsion system to generate a thrust desired by the vessel operator. Therefore, it is possible to bring a hull behavior close to the vessel operator's intentions.

In one embodiment of the present invention, the vessel propulsion system includes a plurality of the propulsion apparatuses designed to be disposed at the hull. The cooperative control unit controls the bow thruster and the propulsion apparatuses so that the hull moves translationally in a direction including a right-left direction component.

According to this arrangement, the cooperative control unit allows the bow thruster and the plurality of propulsion apparatuses to cooperate with each other, thus enabling the vessel propulsion system to generate a thrust by which the hull is translationally moved according to the desire of the vessel operator. Therefore, it is possible to bring a hull behavior close to the vessel operator's intentions.

In one embodiment of the present invention, the plurality of propulsion apparatuses are designed so that a crossing position between lines of action of thrusts each of which is generated by each of the plurality of propulsion apparatuses is variable within a range including a more rearward position than a rotational center of the hull.

According to this arrangement, it is possible to generate the thrust of the bow thruster at a more forward position than the rotational center of the hull and allow a resultant force of thrusts of the plurality of propulsion apparatuses to act at a more rearward position than the rotational center of the hull. At this time, if a moment by the thrust of the bow thruster and a moment by the resultant force cancel each other, it is possible to prevent the veering of the hull. This makes it possible to translationally move the hull in a direction desired by the vessel operator. Therefore, it is possible to bring a hull behavior close to the vessel operator's intentions.

In one embodiment of the present invention, the bow thruster includes a bow turning unit that changes a direction of a thrust with respect to the hull. The cooperative control unit controls the bow turning unit in accordance with at least one of a magnitude and a direction of a thrust of the propulsion apparatus so that the hull moves translationally in a direction including a right-left direction component.

According to this arrangement, the cooperative control unit controls the bow turning unit in accordance with at least one of the magnitude and the direction of the thrust of the propulsion apparatus, and changes the direction of the thrust of the bow thruster. As thus described, the direction of the thrust is changed so that the bow thruster assists the propulsion apparatus, thus enabling the vessel propulsion system to generate a thrust by which the hull is translationally moved according to the desire of the vessel operator. Therefore, it is possible to bring a hull behavior close to the vessel operator's intentions.

In one embodiment of the present invention, the propulsion apparatus is only one propulsion apparatus that is mounted on the hull besides the bow thruster.

According to this arrangement, cooperation between the bow thruster and the only one propulsion apparatus enables the vessel propulsion system to generate a thrust desired by the vessel operator. Therefore, it is possible to bring a hull behavior close to the vessel operator's intentions.

In one embodiment of the present invention, when the hull is veered by a thrust generated by the propulsion apparatus, the cooperative control unit controls the bow thruster so as to generate a thrust by which a veer of the hull is hastened or prevented.

According to this arrangement, the vessel propulsion system allows the hull to generate a moment desired by the vessel operator by means of cooperation between the propulsion apparatus and the bow thruster, and, as a result, it is possible to bring a hull behavior in veering close to the vessel operator's intentions.

In one embodiment of the present invention, when a veer of the hull is prevented by a thrust generated by the propulsion apparatus, the cooperative control unit controls the bow thruster so as to generate a thrust by which prevention of the veer of the hull is assisted.

According to this arrangement, the vessel propulsion system reduces the moment of the hull according to the desire of the vessel operator by means of cooperation between the propulsion apparatus and the bow thruster, and, as a result, it is possible to bring a hull behavior, in preventing veering, close to the vessel operator's intentions.

In one embodiment of the present invention, when a position of the hull is maintained by a thrust generated by the propulsion apparatus, the cooperative control unit controls the bow thruster so as to generate a thrust by which maintenance of the position of the hull is assisted.

According to this arrangement, both a thrust generated by the propulsion apparatus and a thrust generated by the bow thruster enable the vessel propulsion system to bring a hull behavior, in position maintenance, close to the vessel operator's intentions.

In one embodiment of the present invention, the cooperative control unit measures a drivable time of the bow thruster and issues a warning when the drivable time falls below a predetermined threshold.

According to this arrangement, it is possible to avoid the occurrence of a bow-thruster undrivable state at an unintended timing of the vessel operator even when the continuous driving of the bow thruster is limited to a fixed time.

In one embodiment of the present invention, the propulsion apparatus is designed to allow a thrust to act on the hull at a more rearward position than the rotational center of the hull.

According to this arrangement, it is possible to allow the thrust of the bow thruster to act on the hull at a more forward position than the rotational center of the hull, and it is possible to allow the thrust of the propulsion apparatus to act on the hull at a more rearward position than the rotational center of the hull. At this time, if a moment by the thrust of the bow thruster and a moment by the thrust of the propulsion apparatus cancel each other, it is possible to prevent the veering of the hull. This enables the hull to move translationally in a direction desired by the vessel operator. Therefore, it is possible to bring a hull behavior close to the vessel operator's intentions.

One embodiment of the present invention provides a vessel that includes a hull and the vessel propulsion system that is mounted on the hull. According to this arrangement, cooperation between the bow thruster and the propulsion apparatus enables the vessel propulsion system to generate a thrust desired by the vessel operator. Therefore, it is possible to bring a hull behavior close to the vessel operator's intentions.

The above and other elements, features, steps, characteristics and advantages of the present invention will become more apparent from the following detailed description of the preferred embodiments with reference to the attached drawings.

DETAILED DESCRIPTION

Preferred embodiments of the present invention will be hereinafter described in detail with reference to the accompanying drawings.

Figure 1:
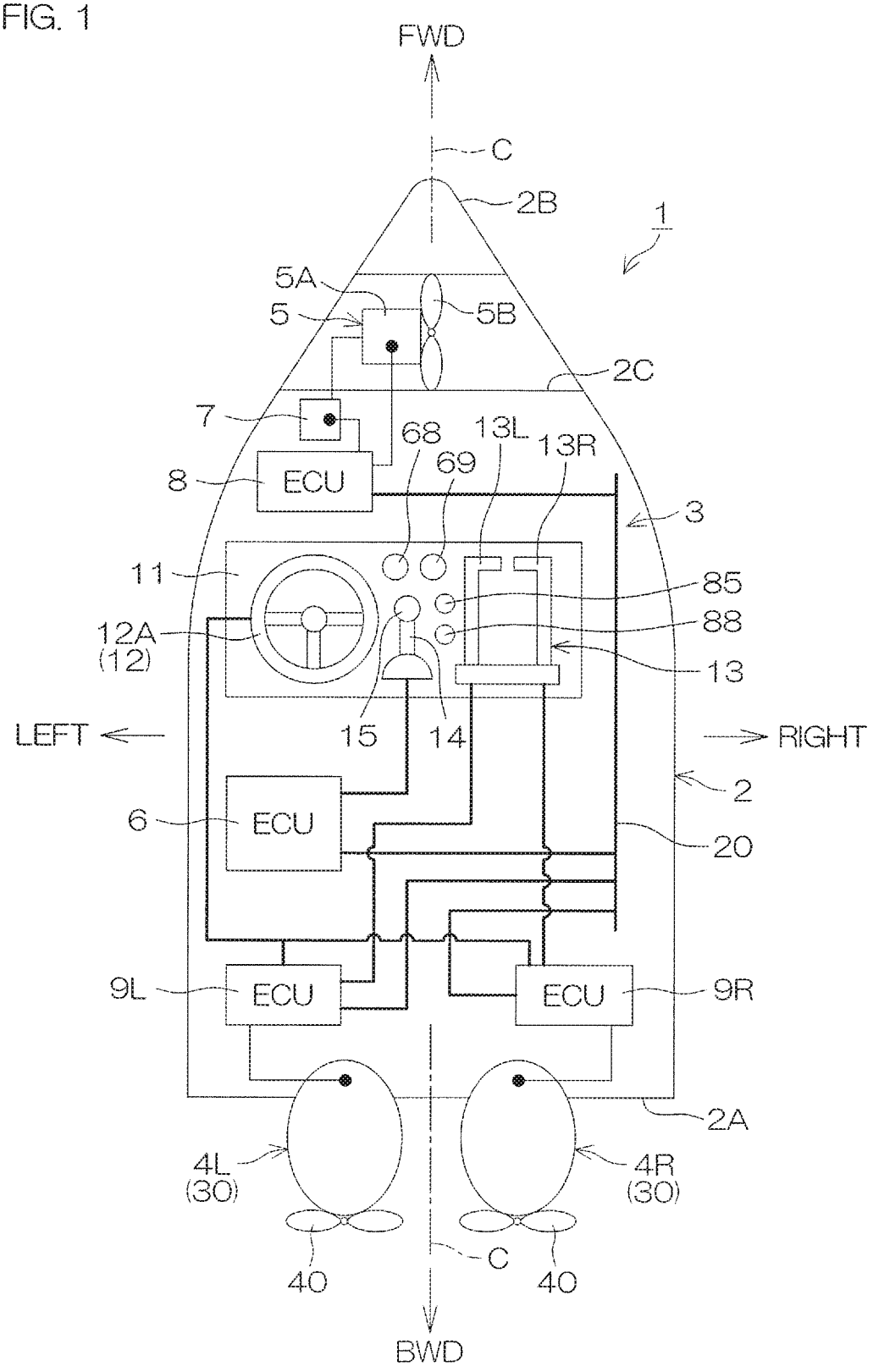
FIG. 1 is a conceptual diagram to describe an arrangement of a vessel according to one embodiment of the present invention.

FIG. 1 is a conceptual diagram to describe an arrangement of a vessel 1 according to one embodiment of the present invention. In the drawing, a forward direction (bow direction, or a direction from the stern toward the bow) of the vessel 1 is represented by an arrow FWD, and its backward direction (stern direction, or a direction from the bow toward the stern) is represented by an arrow BWD. Additionally, a right-hand side direction (starboard side direction) of the vessel 1 is represented by an arrow RIGHT, and its left-hand side direction (port side direction) is represented by an arrow LEFT.

The vessel 1 includes a hull 2 and a vessel propulsion system 3 (hereinafter, referred to as a "propulsion system 3") mounted on the hull 2. The propulsion system 3 includes one or more outboard motors 4 that are an example of a propulsion apparatus, a bow thruster 5 that is provided independently of the outboard motors 4, and a navigation controller 6 that is an example of a cooperative control unit that controls these components.

Figure 5:
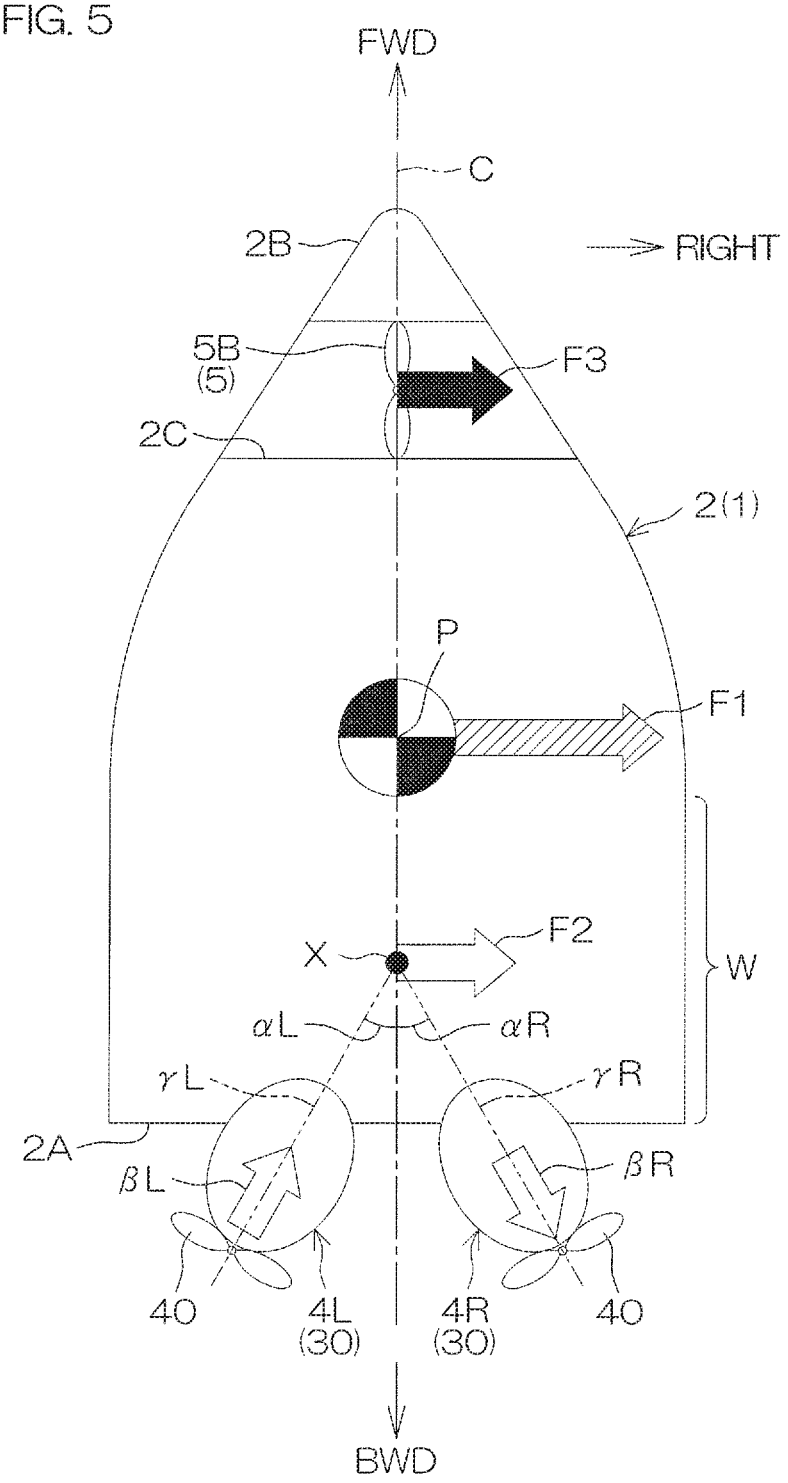
FIG. 5 is a view to describe a vessel behavior by a vessel operation according to the first example.

In the present embodiment, the one or more outboard motors 4 includes a plurality of outboard motors 4 are disposed at a stern (transom) 2A of the hull 2, and are designed to allow a thrust to act on the hull 2 at a more rearward position than a momentary rotational center P of the hull 2 (see FIG. 5 etc., described later). In one embodiment, the plurality of outboard motors 4 include a left outboard motor 4L and a right outboard motor 4R that are attached to the stern 2A. The left outboard motor 4L and the right outboard motor 4R are placed at laterally symmetrical positions, respectively, with respect to a center line C passing through the stern 2A and the bow 2B of the hull 2. In detail, the left outboard motor 4L is attached to a port rear portion of the hull 2, whereas the right outboard motor 4R is attached to a starboard rear portion of the hull 2.

The bow thruster 5 is designed to be disposed at the bow 2B of the hull 2. The bow thruster 5 is a propulsion apparatus designed to be disposed in a state in which a thrust in a fixed direction is given to the hull 2. In detail, the bow thruster 5 generates a thrust in a horizontal direction (right-left direction) that crosses (perpendicularly intersects) the center line C of the hull 2. The bow thruster 5 includes an electric motor 5A that undergoes ON/OFF control and a propeller 5B that is driven to make normal rotation or reverse rotation by means of the electric motor 5A that is in an ON state. In the present embodiment, the electric motor 5A is formed of a DC motor. In the present embodiment, the propeller 5B generates a rightward thrust by making normal rotation, and generates a leftward thrust by making reverse rotation. For example, a through-hole 2C that passes through the hull 2 in the right-left direction is formed at a position lower than a water surface near the bow 2B of the hull 2, and the propeller 5B is placed in the through-hole 2C. The electric motor 5A may be formed of an AC (Alternating Current) motor, and the bow thruster 5 may be capable of controlling the number of rotations of the electric motor 5A as described later. A battery 7 that supplies driving electric power to the electric motor 5A is mounted on the hull 2. The battery 7 in the present embodiment is a battery that is exclusively used for the bow thruster 5.

A rotational center P of the hull 2 is placed at a more rearward position than a rotational axis of the propeller 5B of the bow thruster 5 in a plan view. The rotational center P does not necessarily coincide with a gravity center of the hull 2 in a plan view, and is not necessarily placed at a fixed position in the hull 2.

An electronic control unit 8 (hereinafter, referred to as a "bow ECU 8") that controls the rotation direction and ON/OFF of the electric motor 5A is built into the bow thruster 5. An electronic control unit 9L and an electronic control unit 9R (hereinafter, referred to as a "left ECU 9L" and a "right ECU 9R") are built into the left outboard motor 4L and the right outboard motor 4R, respectively. It should be noted that, for convenience, the bow thruster 5 and the bow ECU 8 are shown separately from each other, and the left outboard motor 4L and the left ECU 9L are shown separately from each other, and the right outboard motor 4R and the right ECU 9R are shown separately from each other in FIG. 1.

An operational platform 11 for vessel operation is disposed at the vessel operation seat of the hull 2 to allow an operator of the vessel to access the operational platform 11 while sitting. The operational platform 11 is provided with a steering operation portion 12, such as a steering wheel, that is operated to perform steering, a throttle operation portion 13, such as a throttle lever, that is operated to adjust the output of each of the outboard motors 4, and a joystick 14 that is operated to perform steering and to adjust the output of each of the outboard motors 4 and the output of the bow thruster 5. The steering operation portion 12, the throttle operation portion 13, and the joystick 14 are each an example of an operation element that is operated by the vessel operator in order to indicate the magnitude and the direction of a thrust that should be applied to the hull 2. In the present embodiment, it is possible to perform a vessel operation by using the steering operation portion 12 and the throttle operation portion 13 (hereinafter, referred to as a "steering vessel operation") and a vessel operation by using the joystick 14 (hereinafter, referred to as a "joystick vessel operation"). For example, in the operational platform 11, the steering operation portion 12 is placed at a position closer to the left, and the throttle operation portion 13 is placed at a position closer to the right, and the joystick 14 is placed between the steering operation portion 12 and the throttle operation portion 13.

The steering operation portion 12 includes a steering handle 12A that is rotatable rightwardly and leftwardly. The throttle operation portion 13 includes throttle levers 13L and 13R corresponding to the left outboard motor 4L and the right outboard motor 4R, respectively. The left throttle lever 13L is used to control the output of the left outboard motor 4L. The right throttle lever 13R is used to control the output of the right outboard motor 4R. The throttle levers 13L and 13R are rotatable in the front-rear direction within predetermined angular ranges, respectively. The tilt position of each of the throttle levers 13L and 13R when the throttle levers 13L and 13R are tilted forwardly from a neutral position by a predetermined angular amount is a forward shift-in position. The tilt position of each of the throttle levers 13L and 13R when the throttle levers 13L and 13R are tilted backwardly from the neutral position by a predetermined angular amount is a backward shift-in position. A head portion of each of the throttle levers 13L and 13R is bent in a direction in which the throttle levers 13L and 13R are brought close to each other, and forms a substantially horizontal holding portion. This enables the vessel operator to simultaneously rotate both of the throttle levers 13L and 13R and to control the output of the left outboard motor 4L and the output of the right outboard motor 4R while keeping the throttle opening degree of the left outboard motor 4L and the throttle opening degree of the right outboard motor 4R substantially equal to each other.

The joystick 14 is a lever projected from the operational platform 11. The joystick 14 is tiltable freely in forward, backward, leftward, and rightward directions by allowing the vessel operator to perform operations. A head portion of the joystick 14 is provided with a knob 15 that is capable of being rotationally operated around an axis of the joystick 14. The entirety of the joystick 14, instead of the knob 15, may be designed to be capable of being rotationally operated around its axis.

A signal that indicates an operational amount of the steering handle 12A is input into the left ECU 9L and the right ECU 9R. A signal that indicates an operational amount of the throttle lever 13L is input into the left ECU 9L. A signal that indicates an operational amount of the throttle lever 13R is input into the right ECU 9R. A signal that indicates a tilt amount of the joystick 14 and a rotational operation amount of the knob 15 is input into the navigation controller 6. The navigation controller 6 is an ECU that includes a microcomputer. The navigation controller 6 communicates with the bow ECU 8, with the left ECU 9L, and with the right ECU 9R through a LAN (Local Area Network, hereinafter, referred to as an "inboard LAN") 20 disposed in the hull 2. In detail, the navigation controller 6 obtains the rotation speed of an engine included in each of the outboard motors 4 from the left ECU 9L and the right ECU 9R (hereinafter, referred to collectively as an "outboard motor ECU 9" when necessary). In the joystick vessel operation, the navigation controller 6 gives data that indicates a target shift position (forward, neutral, and backward), a target throttle opening degree, and a target steering angle to each outboard motor ECU 9. The navigation controller 6 obtains rotation speed information about the propeller 5B from the bow ECU 8. The navigation controller 6 gives a command concerning the ON/OFF and a target rotation direction of the electric motor 5A to the bow ECU 8. A circuit by which the ON/OFF of the electric motor 5A is switched, instead of the bow ECU 8, may be provided, and, if so, the navigation controller 6 controls this circuit, thus controlling the electric motor 5A.

Figure 2:
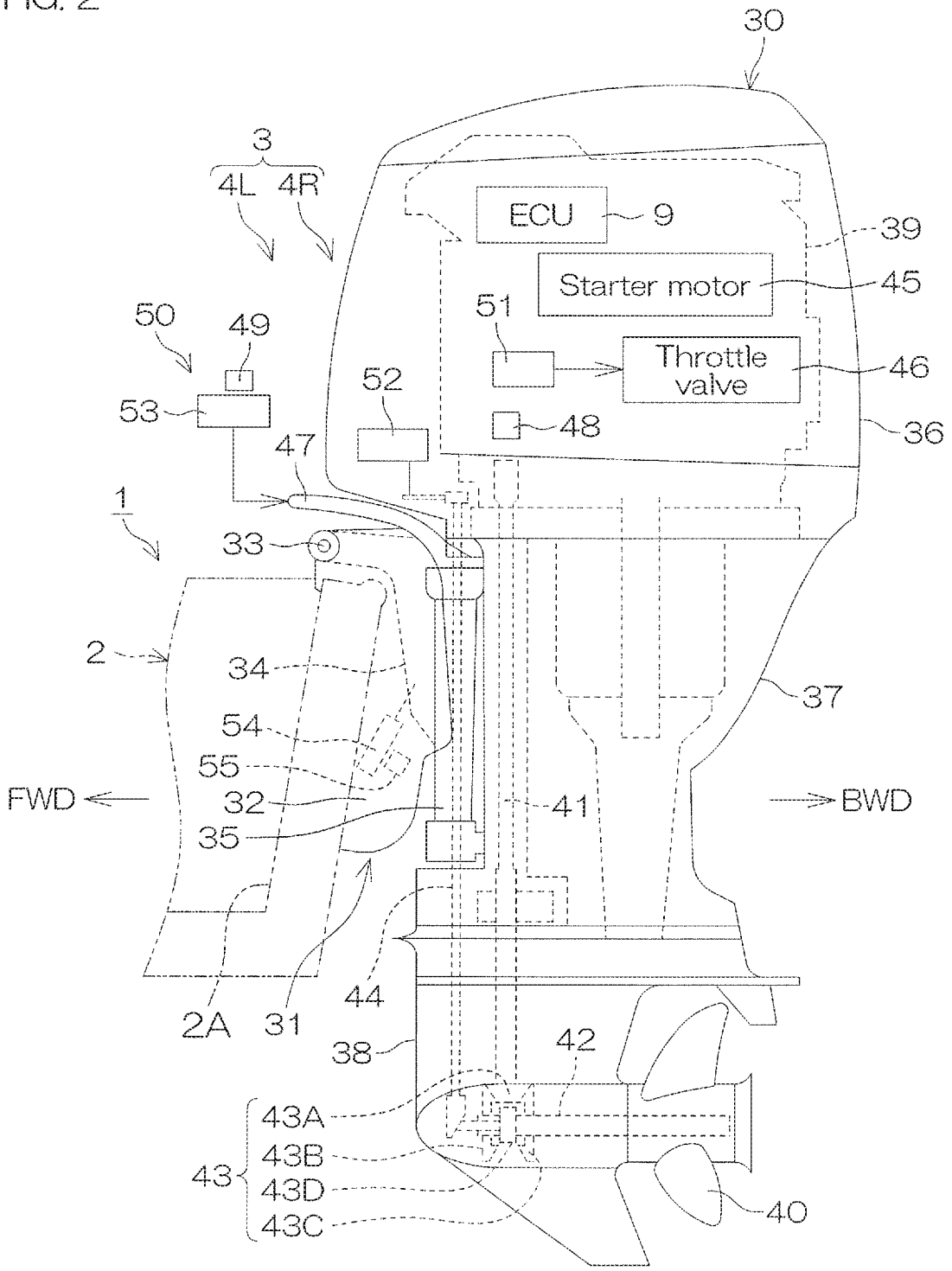
FIG. 2 is an illustrative cross-sectional view to describe an arrangement of a propulsion apparatus included in the vessel.

FIG. 2 is an illustrative cross-sectional view to describe a common arrangement of both the left outboard motor 4L and the right outboard motor 4R. Each of the outboard motors 4 includes a propulsion unit 30 and an attachment mechanism 31 to attach the propulsion unit 30 to the stern 2A of the hull 2. The attachment mechanism 31 includes a clamp bracket 32 that is detachably fixed to the stern 2A and a swivel bracket 34 that is joined to the clamp bracket 32 rotatably around a tilt shaft 33 that serves as a horizontal rotational shaft. The propulsion unit 30 is attached to the swivel bracket 34 rotatably around a steering shaft 35 that serves as a perpendicular rotational shaft. Hence, it is possible to change a steering angle (direction of a thrust with respect to the center line C of the hull 2) by rotating the propulsion unit 30 around the steering shaft 35. Additionally, it is possible to change the trim angle of the propulsion unit 30 by rotating the swivel bracket 34 around the tilt shaft 33. The trim angle corresponds to the setting angle of the outboard motor 4 with respect to the hull 2.

A housing of the propulsion unit 30 is composed of a top cowling 36, an upper case 37, and a lower case 38. An engine 39 that serves as a driving source is installed in the top cowling 36 so that an axis of its crankshaft extends in an up-down direction. A drive shaft 41 for power transmission that is connected to a lower end of the crankshaft of the engine 39 passes through the inside of the upper case 37 in the up-down direction, and extends to the inside of the lower case 38.

A propeller 40 that serves as a thrust-generating member is rotatably attached to the rear of a lower portion of the lower case 38. A propeller shaft 42 that is a rotational shaft of the propeller 40 is passed in the horizontal direction in the lower case 38. The rotation of the drive shaft 41 is transmitted to the propeller shaft 42 through a shift mechanism 43 that serves as a clutch mechanism.

The shift mechanism 43 includes a driving gear 43A that is fixed to a lower end of the drive shaft 41, a forward gear 43B and a backward gear 43C that are rotatably placed on the propeller shaft 42, and a dog clutch 43D placed between the forward gear 43B and the backward gear 43C. The driving gear 43A, the forward gear 43B, and the backward gear 43C are each formed of a bevel gear. The forward gear 43B is engaged with the driving gear 43A from the front, whereas the backward gear 43C is engaged with the driving gear 43A from the rear. Therefore, the forward gear 43B and the backward gear 43C are rotated in mutually opposite directions.

The dog clutch 43D is spline-coupled to the propeller shaft 42. In detail, the dog clutch 43D is slidable with respect to the propeller shaft 42 in its axial direction, and yet the dog clutch 43D cannot make relative rotation with respect to the propeller shaft 42, and rotates together with the propeller shaft 42. The dog clutch 43D is slid on the propeller shaft 42 by the rotation around an axis of a shift rod 44 extending in the up-down direction in parallel with the drive shaft 41. Hence, the dog clutch 43D is controlled in any shift position among a forward position in which it is coupled to the forward gear 43B, a backward position in which it is coupled to the backward gear 43C, and a neutral position in which it is coupled to neither the forward gear 43B nor the backward gear 43C.

When the dog clutch 43D is in the forward position, the rotation of the forward gear 43B is transmitted to the propeller shaft 42 through the dog clutch 43D. Hence, the propeller 40 rotates in one direction, and generates a thrust in a direction (forward direction) in which the hull 2 is advanced. The rotation of the propeller 40 at this time is referred to as "normal rotation." On the other hand, when the dog clutch 43D is in the backward position, the rotation of the backward gear 43C is transmitted to the propeller shaft 42 through the dog clutch 43D. The backward gear 43C rotates in an opposite direction that is opposite to the rotational direction of the forward gear 43B, and therefore the propeller 40 rotates in the opposite direction, and generates a thrust in a direction (backward direction) in which the hull 2 is backwardly moved. The rotation of the propeller 40 at this time is referred to as "reverse rotation." When the dog clutch 43D is in the neutral position, the rotation of the drive shaft 41 is not transmitted to the propeller shaft 42. In other words, a driving-force transmission path between the engine 39 and the propeller 40 is shut off, and therefore a thrust in any direction is not generated.

With respect to the engine 39, a starter motor 45 is provided to start the engine 39. The starter motor 45 is controlled by the outboard motor ECU 9. A throttle actuator 51 is additionally provided to change an amount of inhaled air of the engine 39 by changing a throttle opening degree by actuating a throttle valve 46 of the engine 39. The throttle actuator 51 may be formed of an electric motor. The operation of the throttle actuator 51 is controlled by the outboard motor ECU 9. The engine 39 is additionally provided with a throttle-opening-degree sensor 48 to detect a throttle opening degree.

With respect to the shift rod 44, a shift actuator 52 (clutch actuation device) is provided to change the shift position of the dog clutch 43D. The shift actuator 52 is formed of, for example, an electric motor, and its operation is controlled by the outboard motor ECU 9.

For example, a steering rod 47 that forwardly extends is fixed to the propulsion unit 30. A steering actuator 53 that is controlled by the outboard motor ECU 9 is joined to the steering rod 47. The steering actuator 53 can have an arrangement including, for example, a DC servo motor and a decelerator. The steering actuator 53 is driven, and, as a result, it is possible to rotate the propulsion unit 30 around the steering shaft 35, and it is possible to perform a steering operation. As thus described, the steering actuator 53, the steering rod 47, and the steering shaft 35 constitute a turning unit 50 that changes a steering angle in the outboard motor 4. The turning unit 50 is provided with a steering angle sensor 49 to detect a steering angle. The steering angle sensor 49 is formed of, for example, a potentiometer.

A trim actuator 54 that includes, for example, a hydraulic cylinder and that is controlled by the outboard motor ECU 9 is disposed between the clamp bracket 32 and the swivel bracket 34. The trim actuator 54 rotates the propulsion unit 30 around the tilt shaft 33 by rotating the swivel bracket 34 around the tilt shaft 33. These components constitute a trim unit to change the trim angle of the propulsion unit 30. The trim angle is detected by a trim angle sensor 55. An output signal of the trim angle sensor 55 is input into the outboard motor ECU 9.

Figure 3:
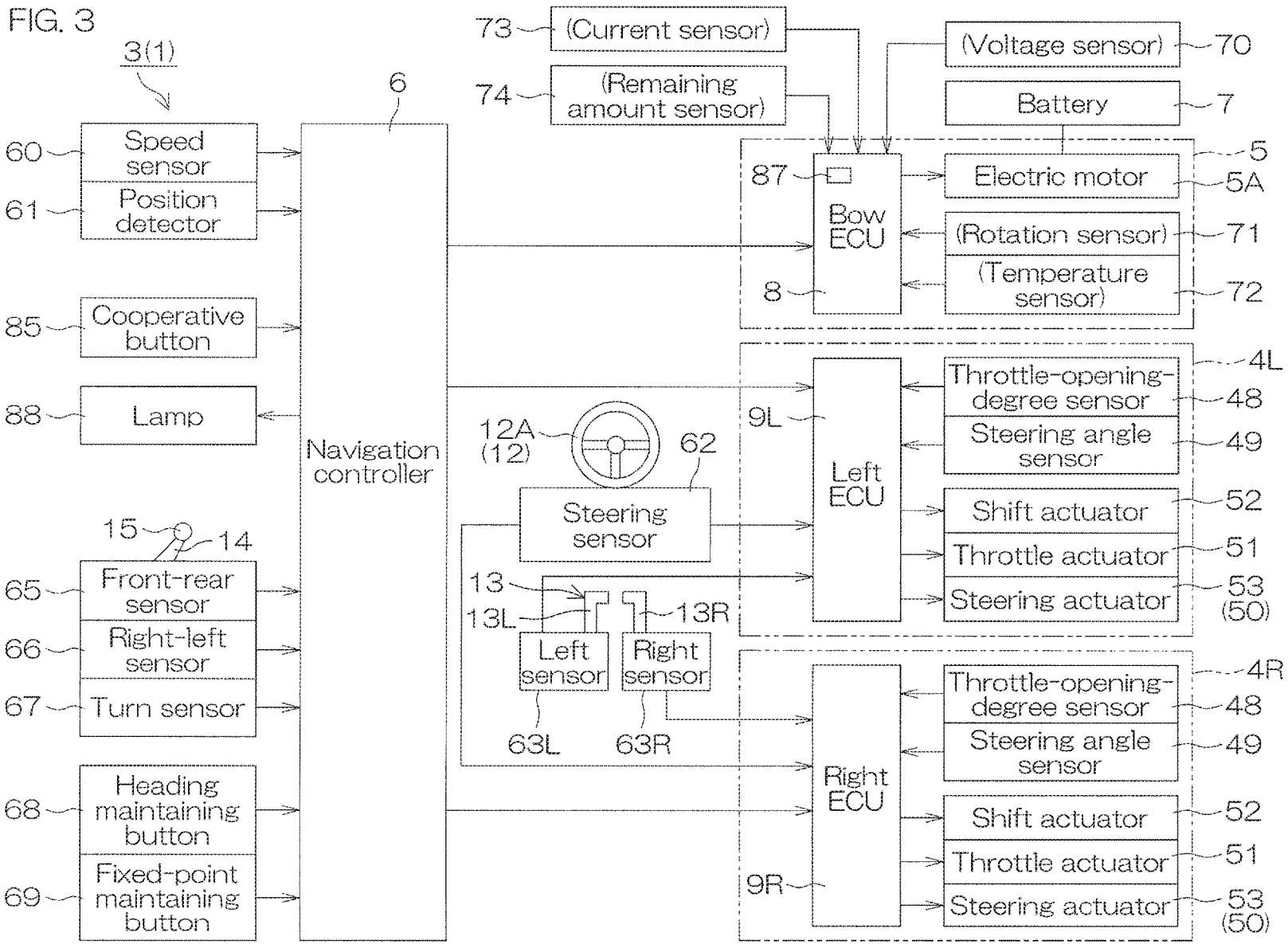
FIG. 3 is a block diagram showing an electrical configuration of a vessel propulsion system included in the vessel.

FIG. 3 is a block diagram showing an electrical configuration of the propulsion system 3. The propulsion system 3 additionally includes a speed sensor 60 that detects and inputs the forward speed and the reverse speed of the vessel 1 into the navigation controller 6 and a position detector 61 that generates and inputs a present-position signal of the vessel 1 into the navigation controller 6. The speed sensor 60 can be formed by use of a pitot tube. The speed sensor 60 may be a device that detects a speed through the water or a device that detects a ground speed. The position detector 61 is a device that generates a present-position signal of the vessel 1, and can be formed of, for example, a GPS receiver that receives radio waves from a GPS (Global Positioning System) satellite and that generates present-position information. The present-position signal may include information about the heading of the hull 2 (direction of the stem).

The propulsion system 3 additionally includes a steering sensor 62 that detects and inputs the rotational operation position of the steering handle 12A into the left ECU 9L and the right ECU 9R. The propulsion system 3 additionally includes a left sensor 63L and a right sensor 63R (hereinafter, referred to collectively as a "throttle sensor 63" when necessary) that detect and input a tilt amount in the front-rear direction of the throttle lever 13L and a tilt amount in the front-rear direction of the throttle lever 13R into the left ECU 9L and the right ECU 9R, respectively. The steering sensor 62 and the throttle sensor 63 can be each formed of a potentiometer.

The propulsion system 3 additionally includes a front-rear sensor 65 that detects and inputs the tilt position of the joystick 14 in the front-rear direction into the navigation controller 6 and a right-left sensor 66 that detects and inputs the tilt amount of the joystick 14 in the right-left direction into the navigation controller 6. The propulsion system 3 additionally includes a turn sensor 67 that detects and inputs the operation position (rotational operation direction and rotational operation amount) of the knob 15 into the navigation controller 6. The front-rear sensor 65, the right-left sensor 66, and the turn sensor 67 can be each implemented using a potentiometer, for example.

The propulsion system 3 additionally includes an heading maintaining button 68 that is operated by the vessel operator pressing the button 68 in order to maintain the heading of the hull 2 while preventing the veering of the hull 2 and a fixed-point maintaining button 69 that is operated by the vessel operator pressing the button 69 in order to maintain the position of the hull 2 at a present position. The heading maintaining button 68 and the fixed-point maintaining button 69 are each placed at, for example, a position that is easily reached by fingers of the vessel operator in the operational platform 11 (see FIG. 1). When the heading maintaining button 68 is operated, a signal to maintain a heading is input into the navigation controller 6. When the fixed-point maintaining button 69 is operated, a signal to maintain a position of the hull is input into the navigation controller 6.

The propulsion system 3 additionally includes a voltage sensor 70 that detects and inputs the voltage of the battery 7 that supplies electric power to the electric motor 5A of the bow thruster 5 into the bow ECU 8. The propulsion system 3 additionally includes a rotation sensor 71 that detects and inputs the rotation speed of the electric motor 5A (i.e., the rotation speed of the propeller 5B) into the bow ECU 8 and a temperature sensor 72 that detects and inputs the temperature of the electric motor 5A into the bow ECU 8. The propulsion system 3 additionally includes a current sensor 73 that detects and inputs the electric current of the battery 7 into the bow ECU 8 and a remaining amount sensor 74 that detects and inputs the remaining amount of the battery 7 into the bow ECU 8. The voltage sensor 70 can be implemented, for example, by a voltmeter connected to an electric circuit by which the electric motor 5A and the battery 7 are connected together. The propulsion system 3 is not required to include all of the voltage sensor 70, the rotation sensor 71, the temperature sensor 72, the current sensor 73, and the remaining amount sensor 74, and embodiments of the invention encompass the propulsion system 3 that includes only necessary sensors among these sensors for a given vessel 1.

The navigation controller 6 includes a microcomputer including a CPU (central processing unit) and a memory, and operates substantially as a plurality of functional processing portions by allowing the microcomputer to perform a predetermined software process. In the joystick vessel operation, a target-value setting portion that sets the target value of a thrust allowed to act to the hull 2 and a thrust allocating portion that calculates individual target values concerning a thrust to be generated by each of the outboard motors 4 and by the bow thruster 5 in accordance with the target value set by the target-value setting portion are included in those functional processing portions. The target-value setting portion and the thrust allocating portion may be integrated as one functional processing portion.

The movement of each component of the vessel 1 that is caused by a vessel operation will be hereinafter described. In the vessel 1, it is possible to activate the outboard motor 4 in a state in which the bow thruster 5 has been stopped and to perform a vessel operation that uses only the thrust of the outboard motor 4. When only the thrust of the outboard motor 4 is used, it is possible to perform a steering vessel operation that uses the steering operation portion 12 and the throttle operation portion 13 or perform a joystick vessel operation that uses the joystick 14.

In the steering vessel operation, each outboard motor ECU 9 sets a target steering angle in accordance with the handle steering angle (rotational operation amount and rotation direction) of the steering handle 12A that is detected by the steering sensor 62. In detail, with respect to the rotational operation of the steering handle 12A in the rightward direction from the neutral position, each outboard motor ECU 9 sets a target steering angle for right-handed rotation.

Likewise, with respect to the rotational operation of the steering handle 12A in the leftward direction from the neutral position, each outboard motor ECU 9 sets a target steering angle for left-handed rotation. In any case, the target steering angle is set so that its absolute value (deflection angle from the neutral position) becomes larger in proportion to an increase in the rotational operation amount of the steering handle 12A from the neutral position. Each outboard motor ECU 9 controls its corresponding steering actuator 53 so that a steering angle detected by the steering angle sensor 49 coincides with the target steering angle. Ordinarily, the target steering angle of the left outboard motor 4L and the target steering angle of the right outboard motor 4R are set to become equal to each other.

The left ECU 9L sets a target shift position and a target throttle opening degree for the left outboard motor 4L in accordance with the tilt amount of the throttle lever 13L detected by the left sensor 63L. The right ECU 9R sets a target shift position and a target throttle opening degree for the right outboard motor 4R in accordance with the tilt amount of the throttle lever 13R detected by the right sensor 63R.

In detail, if a forward tilt amount of the throttle lever 13L is equal to or more than a value corresponding to the forward shift-in position, the left ECU 9L sets the target shift position of the left outboard motor 4L as the forward position. If the throttle lever 13L goes beyond the forward shift-in position and is further tilted forwardly, the left ECU 9L sets a larger target throttle opening degree in proportion to an increase in its tilt amount. Likewise, if a rearward tilt amount of the throttle lever 13L is equal to or more than a value corresponding to the backward shift-in position, the left ECU 9L sets the target shift position of the left outboard motor 4L as the backward position. If the throttle lever 13L goes beyond the backward shift-in position and is further tilted rearwardly, the left ECU 9L sets a larger target throttle opening degree in proportion to an increase in its tilt amount.

When the tilt position of the throttle lever 13L is between the forward shift-in position and the backward shift-in position, the left ECU 9L sets the target shift position of the left outboard motor 4L as the neutral position. At this time, the driving force of the engine 39 is not transmitted to the propeller 40, and therefore a thrust from the outboard motor 4 is not generated. In other words, an operating range between the forward shift-in position and the backward shift-in position is a dead zone that does not participate in the generation of a thrust.

With respect to the operation position of the throttle lever 13R detected by the right sensor 63R, the right ECU 9R performs the same process. In other words, the right ECU 9R sets the target shift position and the target throttle opening degree of the right outboard motor 4R in accordance with the operation position of the throttle lever 13R.

When the target shift position and the target throttle opening degree are set in this way, each outboard motor ECU 9 controls its corresponding shift actuator 52 so that the dog clutch 43D is placed at the target shift position. Each outboard motor ECU 9 controls its corresponding throttle actuator 51 so that the throttle opening degree detected by the throttle-opening-degree sensor 48 coincides with the target throttle opening degree.

In the joystick vessel operation, the navigation controller 6 generates the target shift position and the target throttle opening degree of each outboard motor 4 in accordance with the operation in the front-rear direction of the joystick 14 performed by the vessel operator. Additionally, the navigation controller 6 generates the target steering angle of each outboard motor 4 in accordance with the rotational operation of the knob 15 performed by the vessel operator. As another operation example, the navigation controller 6 may generate the target steering angle in accordance with the operation in the right-left direction of the joystick 14 while the navigation controller 6 sets the target shift position and the target throttle opening degree in accordance with the operation in the front-rear direction of the joystick 14.

Specifically, the navigation controller 6 generates the target shift position and the target throttle opening degree in accordance with the tilt amount in the front-rear direction of the joystick 14. More specifically, if a forward tilt amount of the joystick 14 is equal to or more than a value corresponding to the forward shift-in position, the navigation controller 6 sets the target shift position as the forward position. When the joystick 14 goes beyond the forward shift-in position and is further tilted forwardly, the navigation controller 6 sets a larger target throttle opening degree in proportion to an increase in its tilt amount. Likewise, if a rearward tilt amount of the joystick 14 is equal to or more than a value corresponding to the backward shift-in position, the navigation controller 6 sets the target shift position as the backward position. When the joystick 14 goes beyond the backward shift-in position and is further tilted rearwardly, the navigation controller 6 sets a larger target throttle opening degree in proportion to an increase in its tilt amount. When the tilt position in the front-rear direction of the joystick 14 is between the forward shift-in position and the backward shift-in position, the navigation controller 6 sets the target shift position as the neutral position.

The navigation controller 6 sets a target steering angle in accordance with the rotational operation amount and the rotation direction of the knob 15. In detail, with respect to the rotational operation in the rightward direction of the knob 15, a target steering angle for right-handed rotation is set, and its absolute value (deflection angle from the neutral position) is set to become larger in proportion to an increase in the rotational operation amount from the neutral position. Likewise, with respect to the rotational operation in the leftward direction of the knob 15, a target steering angle for left-handed rotation is set, and its absolute value is set to become larger in proportion to an increase in the rotational operation amount from the neutral position.

When a rightward/leftward tilt of the joystick 14 is used to set a target steering angle, the navigation controller 6 sets a target steering angle for right-handed rotation with respect to the tilt operation in the rightward direction of the joystick 14. Likewise, the navigation controller 6 sets a target steering angle for left-handed rotation with respect to the tilt operation in the leftward direction of the joystick 14. In any case, the target steering angle is set so that its absolute value (deflection angle from the neutral position) becomes larger in proportion to an increase in the tilt amount from the neutral position of the joystick 14.

The navigation controller 6 gives target values (target shift position, target throttle opening degree, and target steering angle) set in this way to the outboard motor ECU 9 of each outboard motor 4. Ordinarily, in the vessel operation using the joystick 14, the target value of the left outboard motor 4L and the target value of the right outboard motor 4R are set to become equal to each other. Each outboard motor ECU 9 controls its corresponding shift actuator 52 so that the dog clutch 43D is placed at the target shift position. Each outboard motor ECU 9 controls its corresponding throttle actuator 51 so that the throttle opening degree detected by the throttle-opening-degree sensor 48 coincides with the target throttle opening degree. Each outboard motor ECU 9 controls its corresponding steering actuator 53 so that the steering angle detected by the steering angle sensor 49 coincides with the target steering angle.

In the vessel 1, it is possible to perform not only a vessel operation only by the outboard motor 4 (hereinafter, referred to as a "sole vessel operation") but also a vessel operation by cooperation between the outboard motor 4 and the bow thruster 5 (hereinafter, referred to as a "cooperative vessel operation") as described above. For example, the operational platform 11 is provided with a cooperative button 85 (see FIG. 1 and FIG. 3), and the navigation controller 6 switches a control mode either to a sole mode corresponding to the sole vessel operation or to a cooperative mode corresponding to the cooperative vessel operation in accordance with the pressing of the cooperative button 85 by the vessel operator. Alternatively, the navigation controller 6 may switch the control mode in accordance with, for example, a change in speed of the vessel 1.

In the present embodiment, the joystick 14 is used in the cooperative vessel operation. In other words, in the present embodiment, the cooperative vessel operation is an example of the joystick vessel operation mentioned above. As a matter of course, the steering handle 12A and the throttle operation portion 13 may be used instead of the joystick 14. The navigation controller 6 realizes the cooperative vessel operation by setting a target value of a thrust of each outboard motor 4 and a target value of a thrust of the bow thruster 5 in accordance with the operation of the joystick 14 performed by the vessel operator and controlling each propulsion apparatus (specifically, ECU of each propulsion apparatus) so as to generate an individual target thrust.

As a first example of the cooperative vessel operation, a description will be hereinafter given of a vessel operation in which the hull 2 is translationally moved in a direction (for example, rightward direction) including right-left direction components. "Translational movement" is a rectilinear movement that is not accompanied by veering around the rotational center P of the hull 2.

Figure 4:
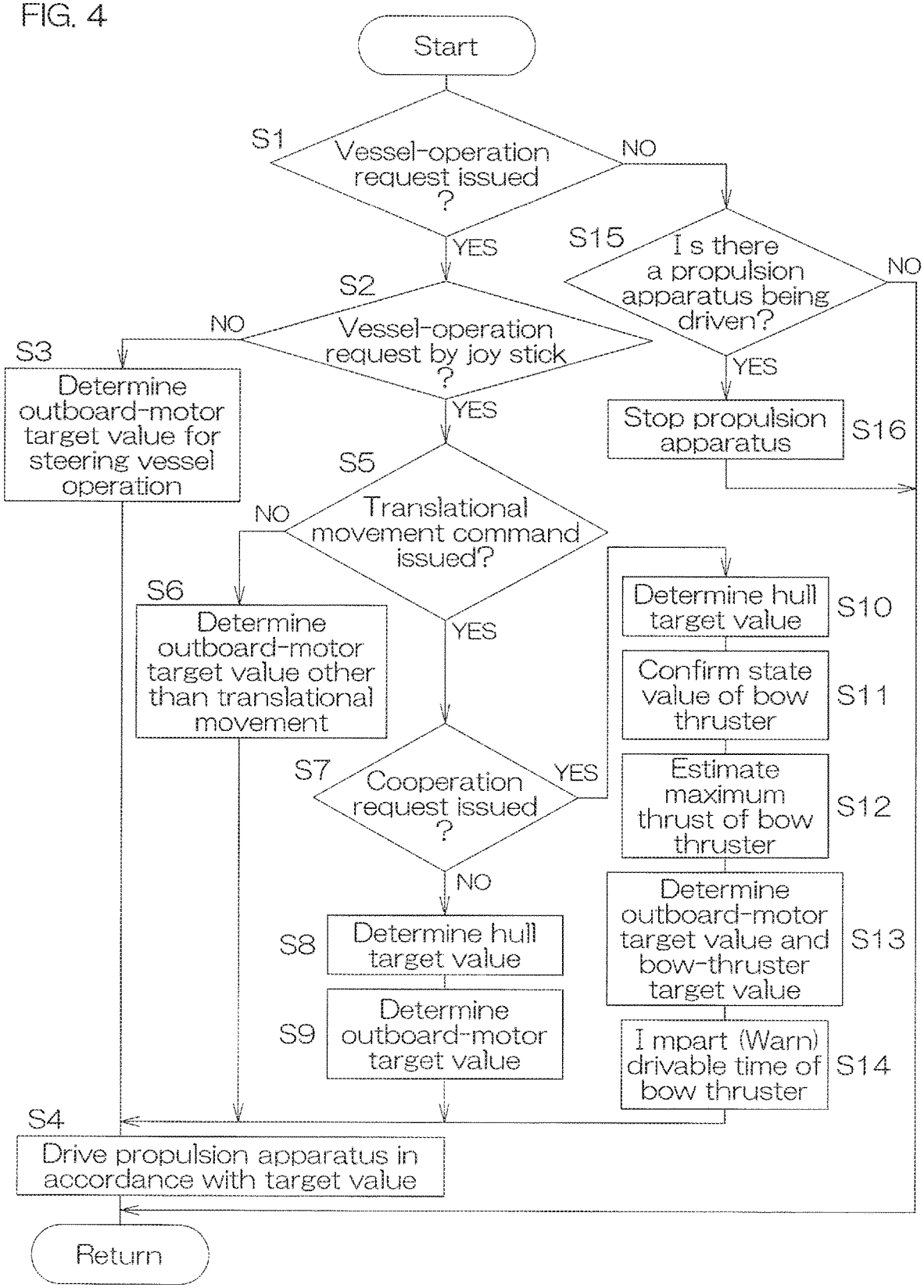
FIG. 4 is a flowchart to describe a vessel operation according to a first example.
Figure 6:
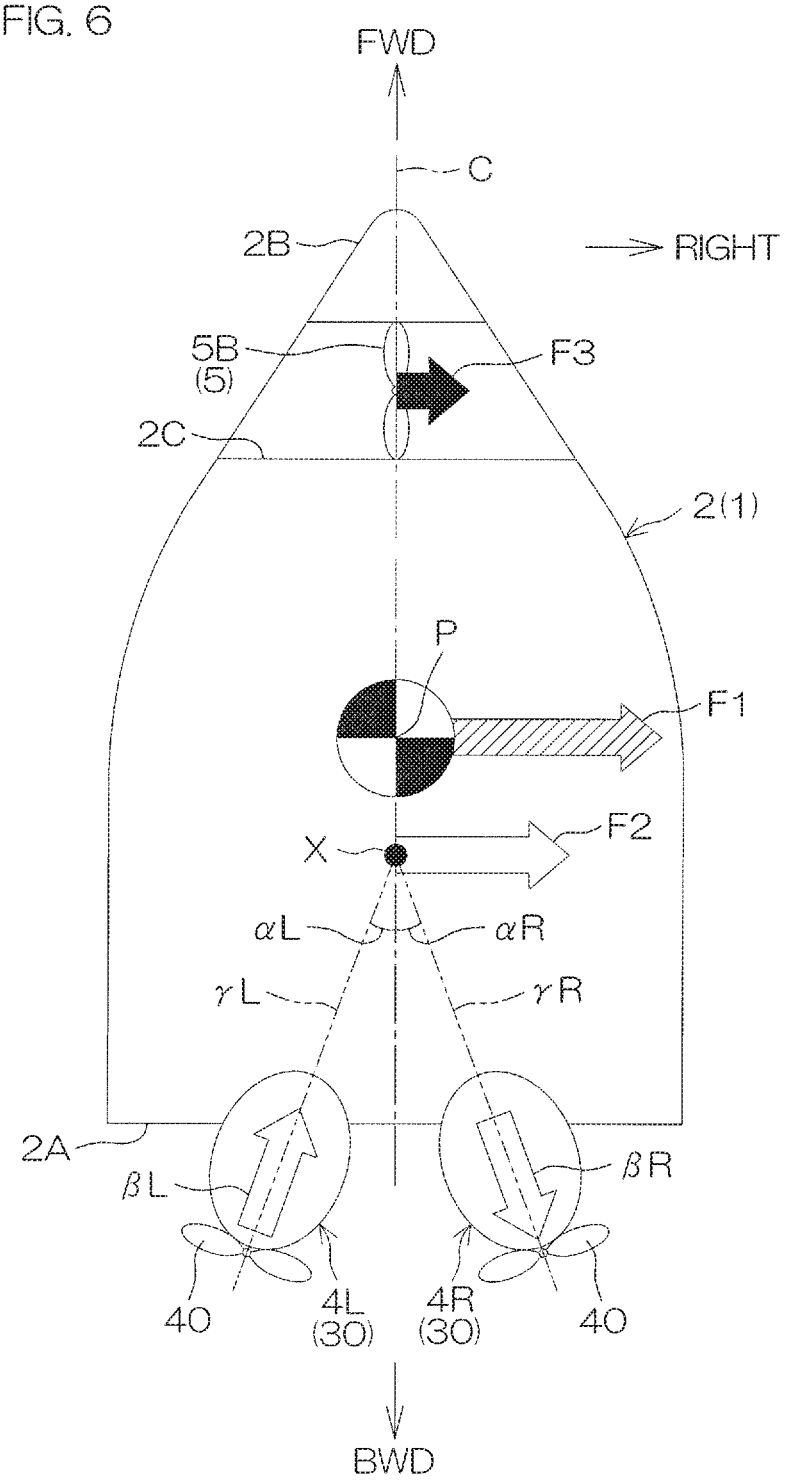
FIG. 6 is a view to describe a vessel behavior by a vessel operation according to the first example.
Figure 7:
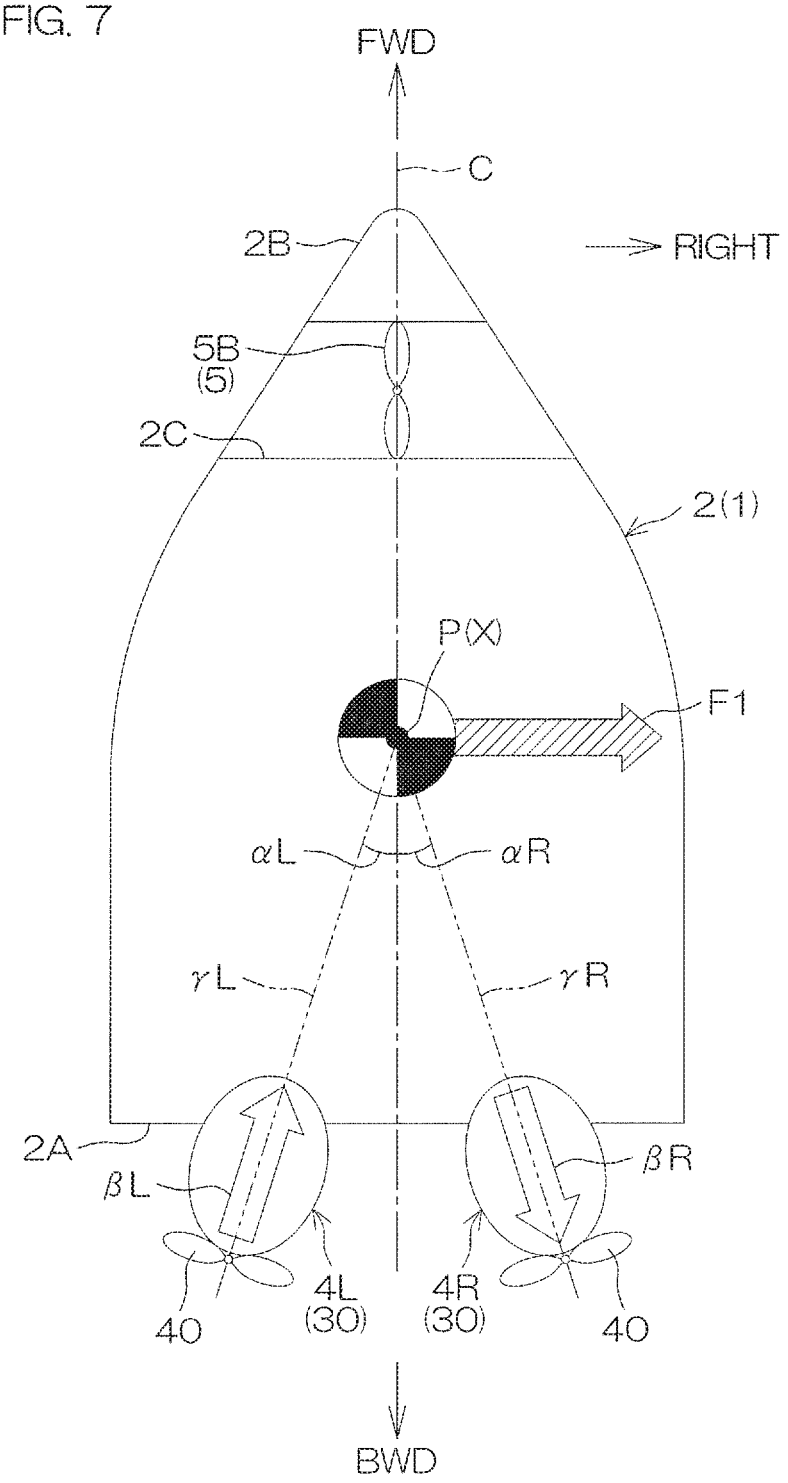
FIG. 7 is a view to describe a vessel behavior by a vessel operation according to the first example.

FIG. 4 is a flowchart to describe a vessel operation according to a first example. FIG. 5 to FIG. 7 are each a schematic plan view to describe a behavior of the vessel 1 by a vessel operation according to the first example. Referring to FIG. 5, the steering angle of each outboard motor 4 is the deflection angle of a rotational axis of the propeller 40 of each outboard motor 4 with respect to the center line C of the hull 2, and a direction from the bow 2B toward the stern 2A is set as 0 degrees, and, with respect to this direction, a right-handed rotational direction (counterclockwise direction) is set as positive, whereas a left-handed rotational direction (clockwise direction) is set as negative. The rotational axis of the propeller 40 coincides with a line of action of a thrust generated by the outboard motor 4 in a plan view.

Hereinafter, the steering angle of the left outboard motor 4L is referred to as a "left steering angle $\alpha L$," and the steering angle of the right outboard motor 4R is referred to as a "right steering angle $\alpha R$." The left steering angle $\alpha L$ and the right steering angle $\alpha R$ are referred to collectively as a "steering angle $\alpha$" when necessary. A thrust generated by the left outboard motor 4L is referred to as a "left thrust $\beta L$," and a thrust generated by the right outboard motor 4R is referred to as a "right thrust $\beta R$." The left thrust $\beta L$ and the right thrust $\beta R$ are referred to collectively as a "thrust $\beta$" when necessary. A line of action of the left thrust $\beta L$ is referred to as a "left line of action $\gamma L$," and a line of action of the right thrust $\beta R$ is referred to as a "right line of action $\gamma R$." The left line of action $\gamma L$ and the right line of action $\gamma R$ are referred to collectively as a "line of action $\gamma$" when necessary. The left outboard motor 4L and the right outboard motor 4R are designed so that a crossing position X between the left line of action $\gamma L$ and the right line of action $\gamma R$ is variable within a range W including more rearward positions than the rotational center P. The rear end of the range W is the stern 2A.

When the vessel operator operates any of the steering handle 12A, the throttle levers 13L and 13R, and the joystick 14, a vessel-operation request issued by the vessel operator is input into the navigation controller 6 or into each outboard motor ECU 9. When a vessel-operation request is input (step S1: YES), this vessel-operation request is input into the outboard motor ECU 9 if the vessel-operation request is made by the steering handle 12A, the throttle lever 13L or the throttle lever 13R (step S2: NO). In this case, each outboard motor ECU 9 determines an outboard-motor target value, which is a target value (target shift position, target throttle opening degree, and target steering angle) of its corresponding outboard motor 4, in order to perform the aforementioned steering vessel operation (step S3). Thereafter, each outboard motor ECU 9 drives the corresponding outboard motor 4 in accordance with the outboard-motor target value (step S4).

A case where the input vessel-operation request is made by the joystick 14 (step S2: YES) and where, for example, the vessel operator rightwardly tilts the joystick 14 shall be assumed. In this case, a signal that indicates a rightward tilt amount of the joystick 14 detected by the right-left sensor 66 is input into the navigation controller 6 as a translational movement command. If the translational movement command is not input (step S5: NO), the navigation controller 6 determines an outboard-motor target value for movements (turn movement, etc.) other than the translational movement by the joystick vessel operation (step S6), and drives its corresponding outboard motor 4 in accordance with the outboard-motor target value (step S4).

A cooperation request is input into the navigation controller 6 when the pressing of the cooperative button 85 performed by the vessel operator who desires the aforementioned cooperative vessel operation is at a timing of a vessel-operation request, or a timing of a translational movement command, or a predetermined timing. On the other hand, when the vessel operator desires the aforementioned sole vessel operation, a cooperation request is not input. When a translational movement command is input (step S5: YES), the navigation controller 6 determines a hull target value that is a target value of a thrust required to act on the hull 2 (step S8) if there is no cooperation request (step S7: NO). Thereafter, the navigation controller 6 determines an outboard-motor target value of each outboard motor 4 according to the hull target value (step S9), and its corresponding outboard motor 4 is driven in accordance with the outboard-motor target value (step S4). Hence, the hull 2 moves translationally only by the thrust of the outboard motor 4.

When a translational movement command is input (step S5: YES), the navigation controller 6 calculates a hull target value (step S10) if there is a cooperation request (step S7: YES). In detail, referring to FIG. 5, it is possible to translationally move the hull 2 rightwardly when a rightward thrust F1 according to the tilt amount of the joystick 14 acts on the hull 2. To do so, a resultant force of the left thrust $\beta L$ and the right thrust $\beta R$ is required to occur at a crossing position X between the left line of action $\gamma L$ and the right line of action $\gamma R$ as a rightward thrust F2, and a thrust F3 of the bow thruster 5 is required to be directed rightwardly. A resultant force of the thrust F2 and the thrust F3 serves as the thrust F1. Additionally, the magnitude of the thrust F2 and the magnitude of the thrust F3 are required to be set so that a yawing moment (hereinafter, referred to as a "moment") around the rotational center P by the thrust F2 and a moment around the rotational center P by the thrust F3 cancel each other. The navigation controller 6 sets a hull target value that is a target value of the thrust F1 in accordance with the tilt amount of the joystick 14.

Thereafter, the navigation controller 6 ascertains a state value of the bow thruster 5 (step S11). The remaining capacity of the battery 7 that supplies electric power to the electric motor 5A of the bow thruster 5 or the temperature of the electric motor 5A can be mentioned as the state value of the bow thruster 5. The remaining capacity of the battery 7 is detected as a remaining amount of the battery 7 by means of the remaining amount sensor 74. Alternatively, the remaining capacity of the battery 7 is estimated on the basis of a voltage value detected by the voltage sensor 70, or a current valve detected by the current sensor 73, or a driving time of the electric motor 5A that is measured by the bow ECU 8. The state value of the bow thruster 5 includes at least any one among the voltage of the battery 7, the electric current of the battery 7, and the remaining amount of the battery 7, and the driving time of the electric motor 5A. A latest remaining amount of the battery 7 is temporarily stored in the bow ECU 8. The temperature of the electric motor 5A is detected by the temperature sensor 72 or is estimated from the driving time of the electric motor 5A, and is temporarily stored in the bow ECU 8. The navigation controller 6 may refer to both of or either of the remaining amount of the battery 7 and the temperature of the electric motor 5A as the state value of the bow thruster 5.

The bow thruster 5 immediately after the start of being driven is capable of generating a rated maximum thrust, and yet the remaining amount of the battery 7 falls, and the temperature of the electric motor 5A rises as a result of being continuously driven, and, for these reasons, the maximum thrust that the bow thruster 5 is capable of generating becomes gradually smaller. A map 87 showing a relationship (thrust characteristic) between each of the remaining amount of the battery 7 and the temperature of the electric motor 5A, i.e., each state value and the maximum thrust that the bow thruster 5 is capable of generating is stored in, for example, the bow ECU 8 (see FIG. 3). Accordingly, the navigation controller 6 estimates the maximum thrust of the bow thruster 5 according to a present state value from the map 87 (step S12).

Thereafter, the navigation controller 6 determines an outboard-motor target value of each outboard motor 4 and a target value of the bow thruster 5 (referred to as a "bow-thruster target value" when necessary) on the basis of the hull target value determined in step S10, the present maximum thrust of the bow thruster 5 estimated in step S12, and the maximum thrust of the outboard motor 4 (step S13). The maximum thrust of the outboard motor 4 is a predetermined value according to the maximum output of the engine 39.

In detail, the navigation controller 6 calculates a target value of the thrust β of each outboard motor 4 and a target value of the thrust F3 of the bow thruster 5 (i.e., an outboard-motor target value and a bow-thruster target value) that are required to allow the thrust F1 to become a target value within a range in which the thrust F3 does not exceed a present maximum thrust. The thrust β includes a magnitude and a direction (direction in which the line of action γ extends). The angle between the line of action γ and the center line C of the hull 2 is a steering angle α in a plan view. In other words, the navigation controller 6 calculates a target value of the thrust β and a target value of the steering angle α with respect to each outboard motor 4.

The navigation controller 6 calculates a target value of the thrust F3 of the bow thruster 5. The target value of the thrust F3 includes a magnitude according to the tilt amount of the joystick 14 and a direction according to the tilt direction of the joystick 14. The direction of the thrust F3 includes a rotation direction of the propeller 5B.

The bow thruster 5 in the present embodiment is capable of being continuously driven, for example, for four minutes, and is required to be stopped for one hour after being continuously driven for four minutes. The navigation controller 6 estimates a remaining period of drivable time of the electric motor 5A by subtracting the driving time of the previously-estimated electric motor 5A from the maximum continuous driving time, i.e., from four minutes. The navigation controller 6 imparts this drivable time (step S14). For example, a lamp 88 connected to the navigation controller 6 is disposed on the operational platform 11 (see FIG. 1 and FIG. 3), and the navigation controller 6 imparts the drivable time by lighting the lamp 88 in a color according to the drivable time. For example, the emission color of the lamp 88 is green when the drivable time is long, and the emission color of the lamp 88 is yellow when the drivable time becomes short, and the emission color of the lamp 88 is red when the drivable time becomes zero. The navigation controller 6 issues a warning that the drivable time of the bow thruster 5 has been lessened by making the emission color of the lamp 88 yellow or red.

Thereafter, the navigation controller 6 drives each outboard motor 4 and the bow thruster 5 on the basis of target values calculated in step S13 (an outboard-motor target value and a bow-thruster target value) (step S4). When the hull 2 is translationally moved rightwardly as shown in FIG. 5, the navigation controller 6 rotates the propulsion unit 30 of the left outboard motor 4L leftwardly, and rotates the propulsion unit 30 of the right outboard motor 4R rightwardly until the absolute value of the steering angle α of each outboard motor 4 becomes a maximum value (for example, 30 degrees). The absolute value of the left steering angle αL and the absolute value of the right steering angle αR are equal to each other. Thereafter, the navigation controller 6 allows the left outboard motor 4L to generate a left thrust βL in the forward direction, and allows the right outboard motor 4R to generate a right thrust βR in the backward direction. Hence, a rightward thrust F2 acts on the crossing position X between the left line of action γL and the right line of action γR. The magnitude of the left thrust βL and the magnitude of the right thrust βR may be each a maximum. Additionally, the navigation controller 6 controls the electric motor 5A so that the bow thruster 5 generates a rightward thrust F3 according to the bow-thruster target value by means of PWM (Pulse Width Modulation) control. As a result, a rightward thrust F1 acts on the hull 2 in a state in which a moment around the rotational center P by the thrust F2 and a moment around the rotational center P by the thrust F3 have canceled each other. Hence, the hull 2 is translationally moved rightwardly at a speed desired by the vessel operator who has handled the joystick 14.

As thus described, when the vessel operator rightwardly tilts the joystick 14 by the same tilt amount as before in a state in which the hull 2 is being translationally moved in the cooperative vessel operation, a hull target value obtained in step S10 becomes equal to an immediately previous hull target value. When the state value changes in accordance with the continuous drive of the bow thruster 5, the maximum thrust of the bow thruster 5 estimated in step S12 changes (actually, decreases). The navigation controller 6 redetermines an outboard-motor target value of each outboard motor 4 and a bow-thruster target value on the basis of this maximum thrust, the hull target value determined in step S10, and the maximum thrust of the outboard motor 4 (step S13). In detail, the navigation controller 6 determines a target value of the thrust β and a target value of the steering angle α with respect to each outboard motor 4 so that the same thrust F1 as before acts on the rotational center P of the hull 2 even if a target value of the rightward thrust F3 of the bow thruster 5 changes.

The navigation controller 6 drives each outboard motor 4 and the bow thruster 5 on the basis of the target value determined in step S13 (step S4). In detail, as shown in FIG. 6, the navigation controller 6 rotates the propulsion units 30 of both outboard motors 4 so as to approach the center line C so that the steering angle α of each outboard motor 4 becomes small and so that the crossing position X between the lines of action γ approaches the rotational center P. In other words, the navigation controller 6 rightwardly rotates the propulsion unit 30 of the left outboard motor 4L, and leftwardly rotates the propulsion unit 30 of the right outboard motor 4R. The absolute value of the left steering angle αL and the absolute value of the right steering angle αR are still equal to each other. The navigation controller 6 increases a forward left thrust βL of the left outboard motor 4L, and increases a backward right thrust βR of the right outboard motor 4R. Therefore, a rightward thrust F2 in the crossing position X increases although a rightward thrust F3 of the bow thruster 5 decreases. As a result, a thrust F1 that is the same in magnitude as before acts on the hull 2 in a state in which a moment around the rotational center P by the thrust F2 and a moment around the rotational center P by the thrust F3 have canceled each other. Therefore, the hull 2 continuously makes a rightward translational movement while maintaining a speed desired by the vessel operator who has handled the joystick 14.

In a state in which the hull 2 is moving translationally in this way, the navigation controller 6 monitors the continuous driving time of the bow thruster 5 during a driving operation, and imparts the remaining drivable time of the bow thruster 5 (issues a warning if necessary) (step S14).

Thereafter, when the vessel operator rightwardly tilts the joystick 14 by the same tilt amount as before, the hull target value obtained in step S10 becomes equal to the immediately previous hull target value. When the state value of the bow thruster 5 reaches a value that is obtained when the bow thruster 5 is not in a drivable state, the present maximum thrust of the bow thruster 5 is zero. Based on this, the navigation controller 6 sets a target value of the rightward thrust F3 of the bow thruster 5 as zero in step S13. Thereafter, the navigation controller 6 determines a target value of the thrust β and a target value of the steering angle α with respect to each outboard motor 4 so that, even if the target value of the thrust F3 is zero, the same thrust F1 acts on the rotational center P of the hull 2.

The navigation controller 6 drives each outboard motor 4 on the basis of the target value determined in step S13 (step S4). In detail, as shown in FIG. 7, the navigation controller 6 rightwardly rotates the propulsion unit 30 of the left outboard motor 4L and leftwardly rotates the propulsion unit 30 of the right outboard motor 4R so that the steering angle α of each outboard motor 4 becomes even smaller and so that the crossing position X between the lines of action γ coincides with the rotational center P in a plan view. The absolute value of the left steering angle αL and the absolute value of the right steering angle αR are still equal to each other, and are larger than zero. The navigation controller 6 increases a forward left thrust βL of the left outboard motor 4L, and increases a backward right thrust βR of the right outboard motor 4R. Therefore, although a rightward thrust F3 of the bow thruster 5 becomes zero, a rightward thrust F2 increases, and acts on the rotational center P of the hull 2 as the same thrust F1 in magnitude as before. Hence, the hull 2 continuously makes a rightward translational movement while maintaining a speed desired by the vessel operator who has handled the joystick 14.

As thus described, the navigation controller 6 controls the bow thruster 5 and the plurality of outboard motors 4 so that the hull 2 moves translationally. Particularly, the navigation controller 6 controls a thrust generated by the outboard motor 4 in accordance with a state of the bow thruster 5. In detail, the navigation controller 6 obtains a state value (in the present embodiment, the temperature of the electric motor 5A or the remaining amount of the battery 7) that affects thrust characteristics of the bow thruster 5, and controls the outboard motor 4 or controls the steering actuator 53 of the turning unit 50 in accordance with the state value.

Thereafter, when the vessel operator returns the joystick 14 to the neutral position, any vessel-operation request is not input (step S1: NO), and therefore, if there is a propulsion apparatus that is being driven (step S15: YES), this propulsion apparatus is stopped (step S16). Hence, the hull 2 stops moving translationally. In this state, the navigation controller 6 waits for the input of a new vessel-operation request (step S1).

In the first example mentioned above, the thrust of the outboard motor 4 is controlled in accordance with the state of the bow thruster 5 so that the hull 2 continuously makes a rightward translational movement while maintaining a speed desired by the vessel operator even if the thrust of the bow thruster 5 changes. As a second example, the navigation controller 6 may control a thrust generated by the bow thruster 5 in accordance with a state of the outboard motor 4 on the supposition that the maximum thrust of the bow thruster 5 is excessive.

Figure 8:
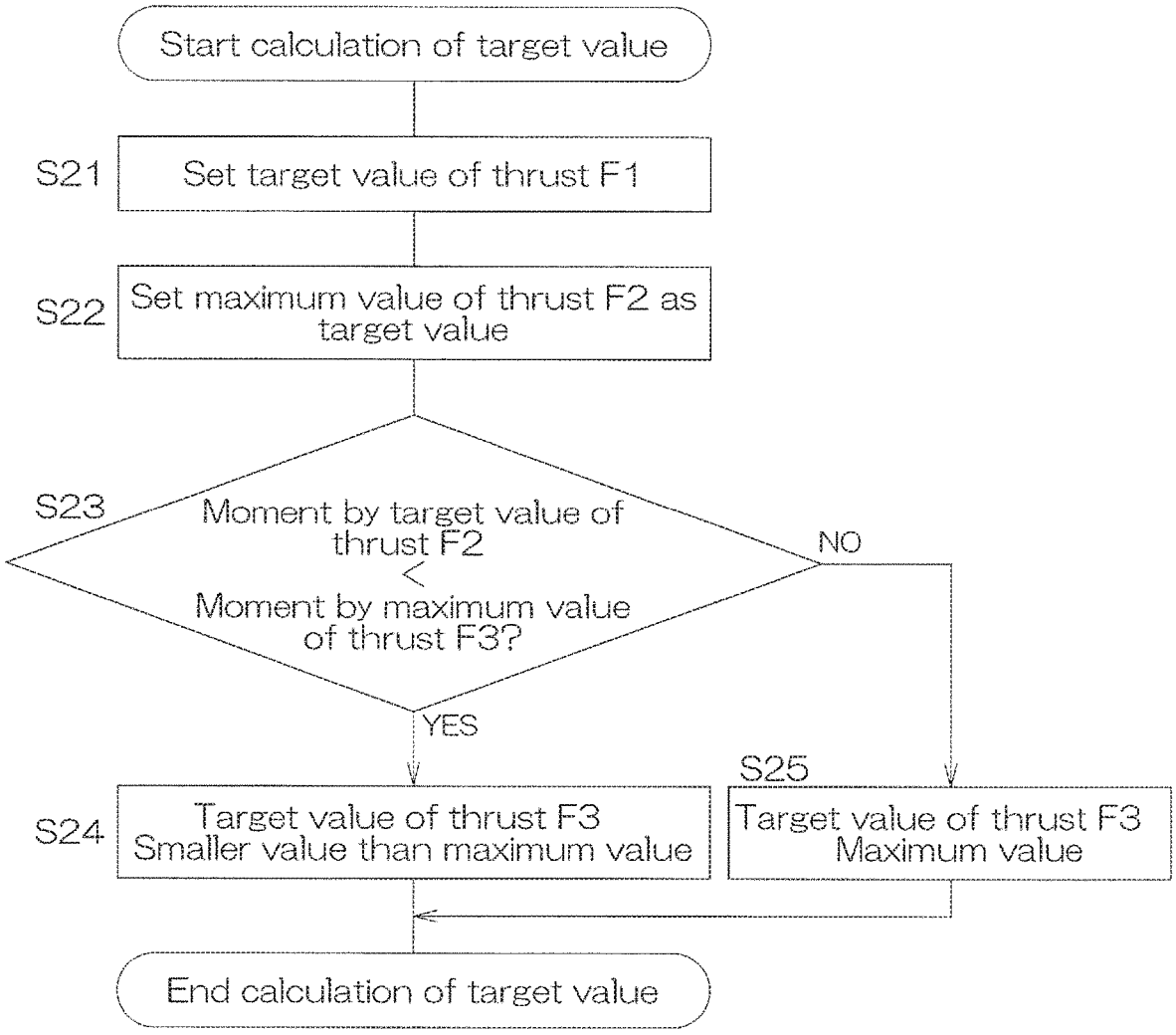
FIG. 8 is a flowchart to describe a vessel operation according to a second example.
Figure 9:
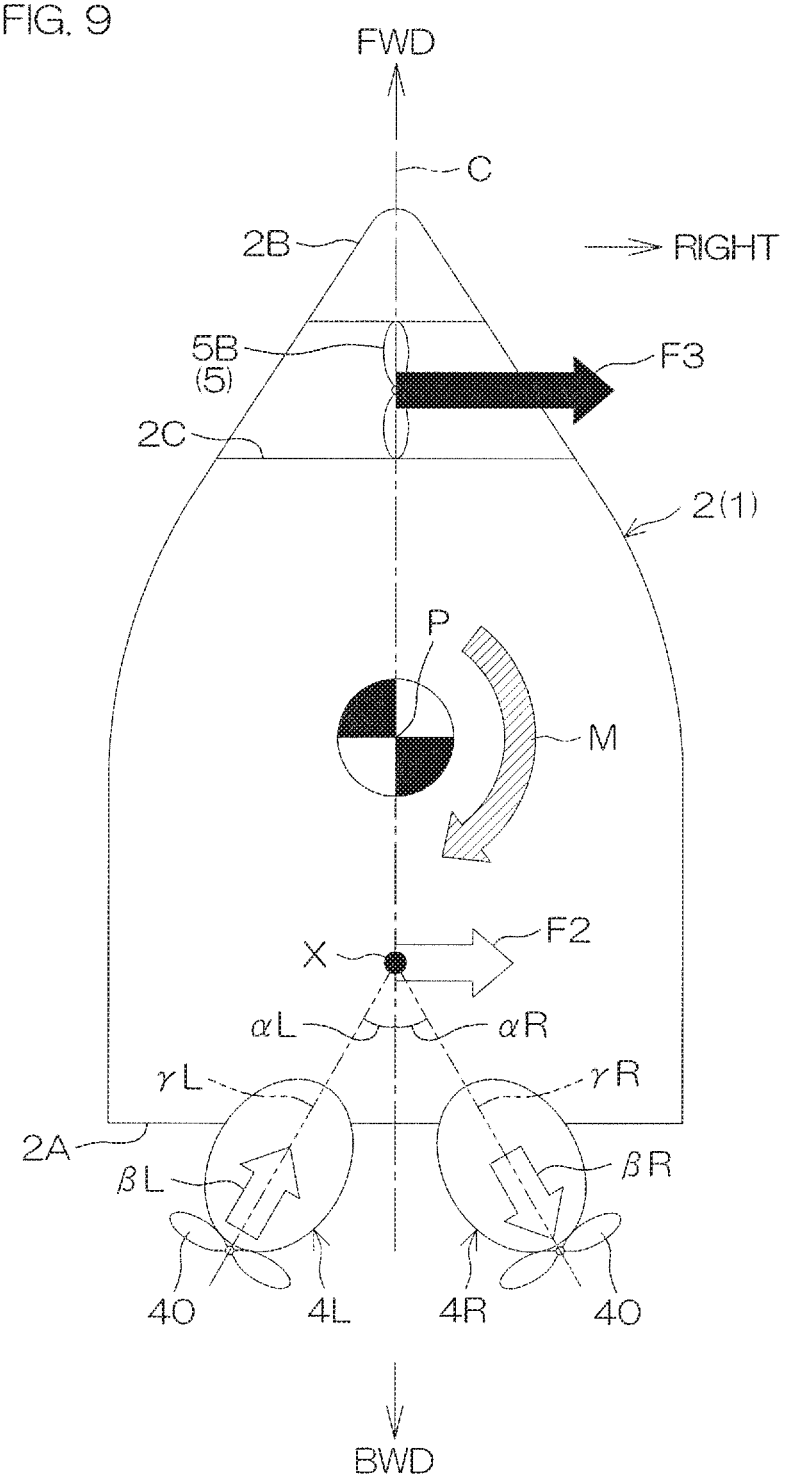
FIG. 9 is a view to describe a vessel behavior by a vessel operation according to the second example.
Figure 10:
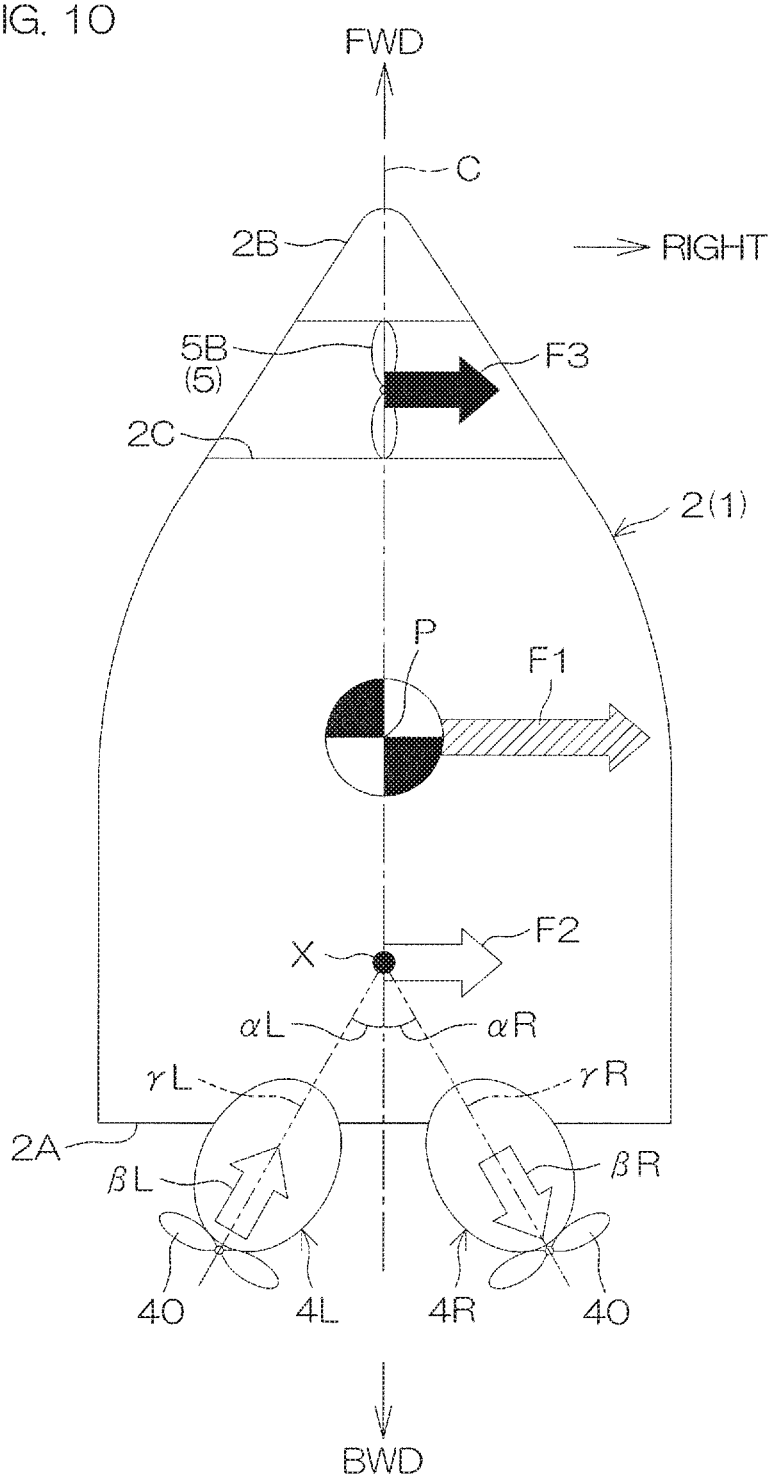
FIG. 10 is a view to describe a vessel behavior by a vessel operation according to the second example.

FIG. 8 is a flowchart to describe a vessel operation according to the second example. FIG. 9 and FIG. 10 are schematic plan views to describe a vessel behavior of the vessel 1 by a vessel operation according to the second example. When a translational movement command is input by the rightward tilt of the joystick 14 by the vessel operator in a state in which a cooperation request has been made as described above (steps S5 and S7: YES), the navigation controller 6 calculates a hull target value (step S10). In that case, in the second example, the navigation controller 6 sets a target value (hull target value) of a thrust F1, which is to act on the hull 2, in accordance with the tilt amount of the joystick 14 as shown in FIG. 8 (step S21). Thereafter, the navigation controller 6 sets the maximum value of a resultant force of thrusts β of both outboard motors 4 as a target value (outboard-motor target value) of a thrust F2 (step S22). In that case, with respect to the left outboard motor 4L, the navigation controller 6 sets the target value of the left thrust βL as a maximum value in the forward direction under the condition that the target value of the steering angle αL is a negative maximum value (herein, −30 degrees) with reference to FIG. 9. Additionally, with respect to the right outboard motor 4R, the navigation controller 6 sets the target value of the right thrust βR as a maximum value in the backward direction under the condition that the target value of the steering angle αR is a positive maximum value (herein, +30 degrees). A process step that follows step 22 corresponds to step S13 mentioned above.

Next, the navigation controller 6 makes a comparison between a moment by the target value of the thrust F2 set in step S22 and a moment by the maximum value (estimated in step S12 mentioned above) of the thrust F3 generated by the bow thruster 5 (step S23). In an arrangement in which the plurality of outboard motors 4 are disposed at the stern 2A, the gravity center of the hull 2 is placed closer to the rear because of the weight of these outboard motors 4, and, as a result, the rotational center P is brought closer to the crossing position X. Therefore, the moment by the target value of the thrust F2 is liable to become smaller than the moment by the maximum value of the thrust F3. If the moment by the target value of the thrust F2 is smaller than the moment by the maximum value of the thrust F3, the hull 2 will veer because of the generation of a moment M around the rotational center P as shown in FIG. 9. In this case (step S23: YES), the navigation controller 6 sets the thrust of the bow thruster 5 when a moment, which just cancels the moment by the target value of the thrust F2, occurs as a target value (bow-thruster target value) of the thrust F3 (step S24). This bow-thruster target value is smaller than the maximum value of the thrust F3. On the other hand, if the moment by the target value of the thrust F2 and the moment by the maximum value of the thrust F3 just cancel each other (step S23: NO), the navigation controller 6 sets the maximum value of the thrust F3 as the bow-thruster target value (step S25).

Based on the target value set in this way, the navigation controller 6 drives each outboard motor 4 and the bow thruster 5 (step S4). In that case, if the target value of the thrust F3 of the bow thruster 5 is set at a value smaller than the maximum value, the navigation controller 6 controls the electric motor 5A so that the thrust F3 of the bow thruster 5 reaches the target value by means of PWM control. Each outboard motor 4 and the bow thruster 5 are driven in this way, and, as a result, the hull 2 is capable of making a rightward translational movement at a speed desired by the vessel operator without veering as shown in FIG. 10.

As thus described, in the second example, the navigation controller 6 controls each outboard motor 4 so as to generate a thrust β having a fixed magnitude (herein, maximum thrust). Additionally, the navigation controller 6 controls the thrust F3 of the bow thruster 5 in accordance with a command given by the joystick 14 of the vessel operator and in accordance with the aforementioned thrust having the fixed magnitude generated by the outboard motor 4.

The bow thruster 5 having the electric motor 5A is high in responsibility, but is low in continuity because the continuous driving time is a comparatively short period of time of four minutes as described above. On the other hand, the outboard motor 4 having the engine 39 is lower in responsibility than the bow thruster 5, but is higher in continuity than the bow thruster 5, and is capable of continuously generating a thrust as long as there is a fuel for the engine 39. As a third example, a description will be hereinafter given of a cooperative vessel operation that uses a difference in responsibility and in continuity between the bow thruster 5 and the outboard motor 4. In the third example, described below, various additional movements of the vessel 1 are provided for by controlling the thruster 5 and outboard motor 4, including heading maintenance and position maintenance.

Figure 11:
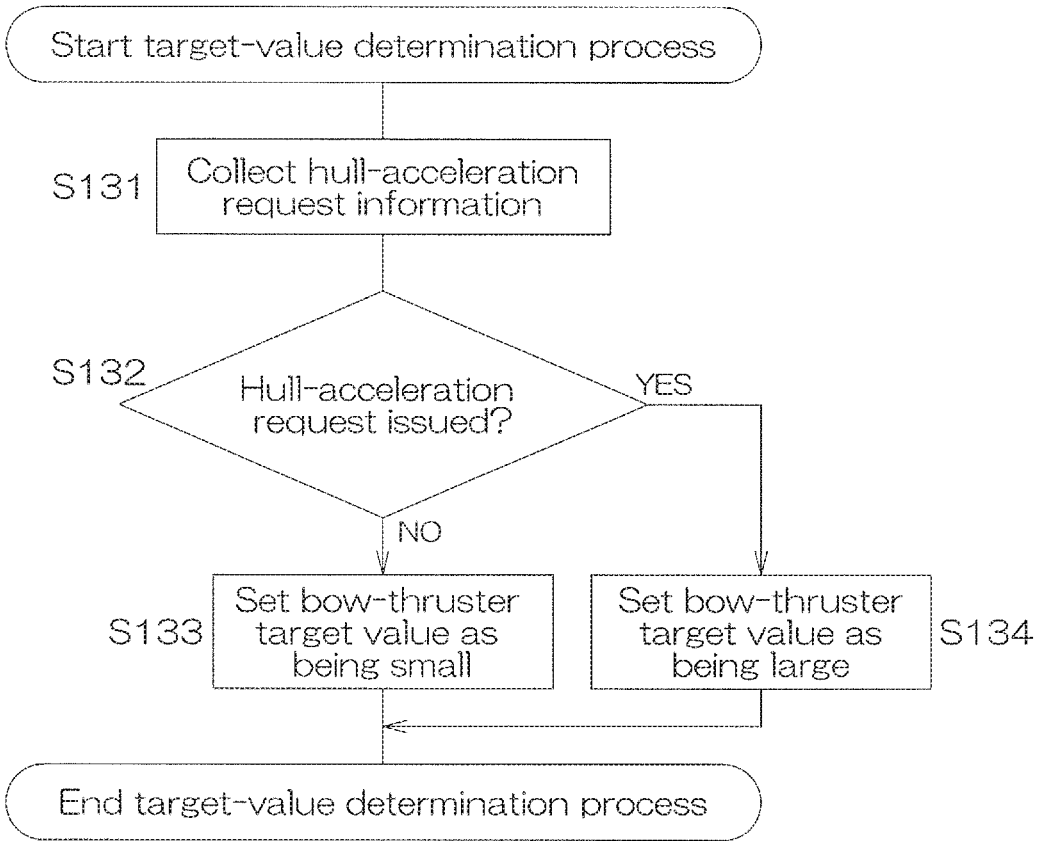
FIG. 11 is a flowchart to describe a vessel operation according to a third example.
Figure 12:
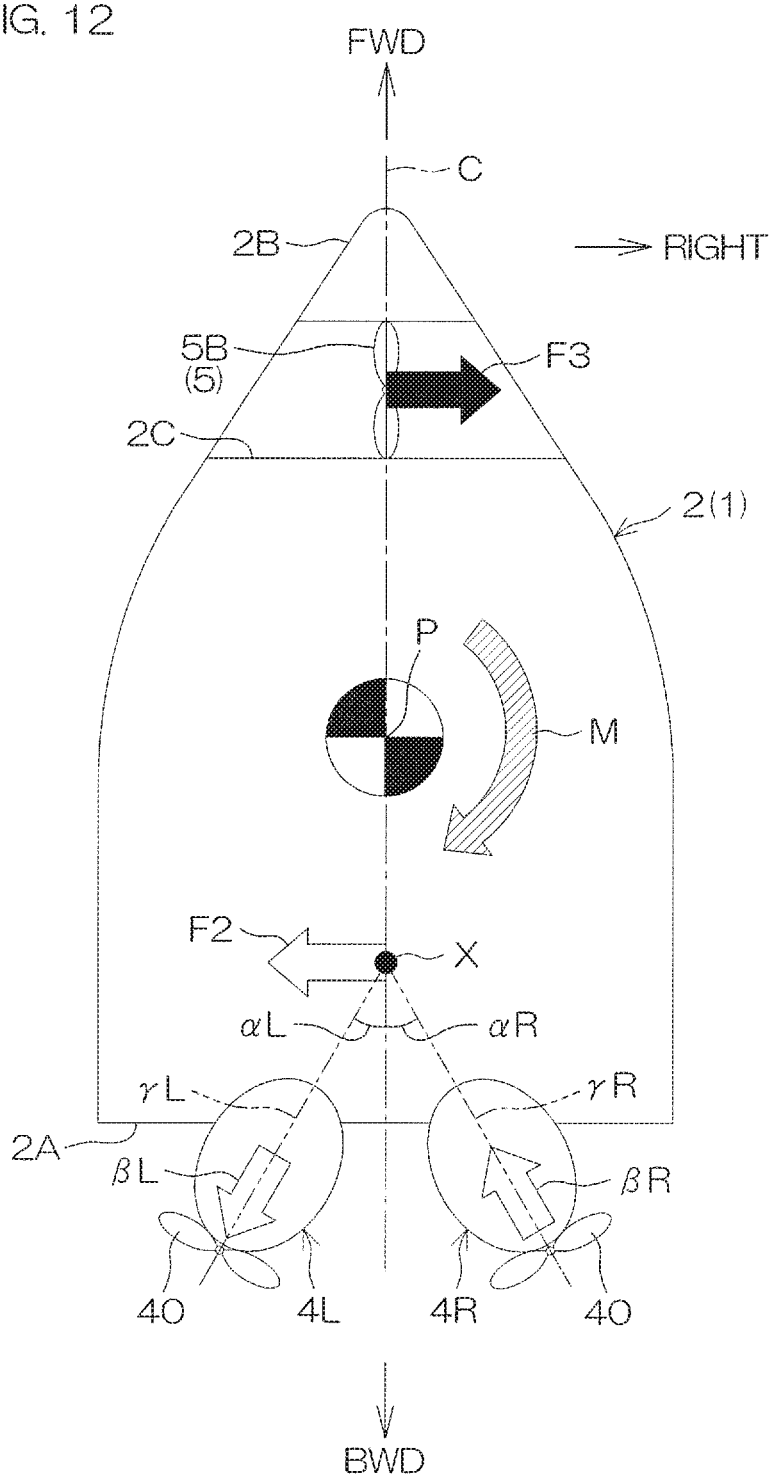
FIG. 12 is a view to describe a vessel behavior by a vessel operation according to the third example.
Figure 13:
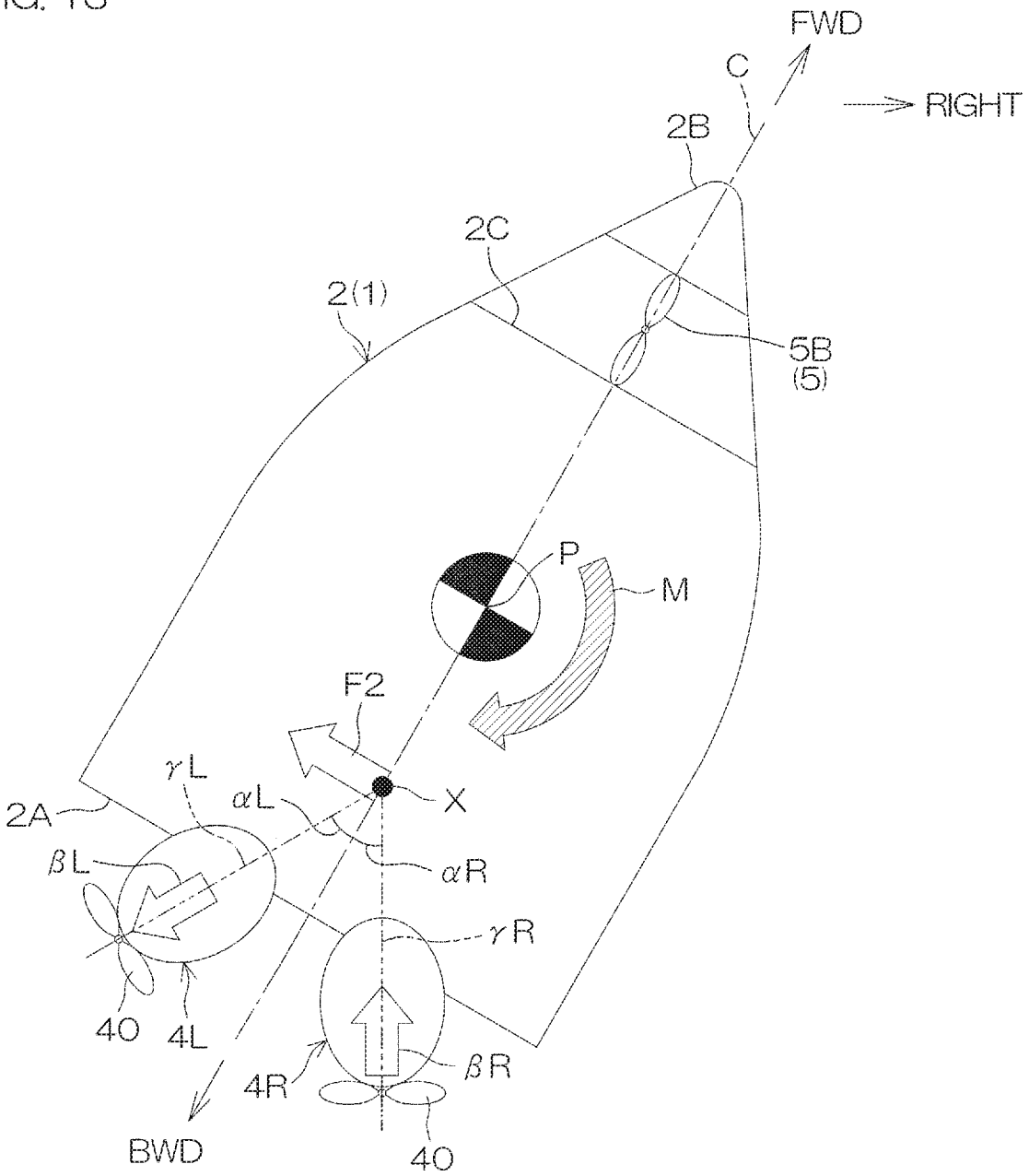
FIG. 13 is a view to describe a vessel behavior by a vessel operation according to the third example.

FIG. 11 is a flowchart to describe a vessel operation according to the third example. FIG. 12 and FIG. 13 are views to describe a behavior of the vessel 1 by a vessel operation according to the third example. When the vessel operator tilts the joystick 14 in an arbitrary direction or rotates the knob 15, a signal that indicates the tilt amount of the joystick 14 or a signal that indicates the rotation direction and the rotational operation amount of the knob 15 is input into the navigation controller 6 as a movement command. When a movement command is input, the navigation controller 6 calculates a target value. In detail, the navigation controller 6 calculates a target value of a thrust that is to act on the hull 2 in accordance with the tilt amount of the joystick 14. Additionally, when the knob 15 is rotationally operated, the navigation controller 6 calculates a target value of a moment that is to act on the hull 2 in accordance with the rotation direction and the rotational operation amount of the knob 15, and calculates a target value of a thrust that is to be generated by each of the outboard motor 4 and the bow thruster 5 (step S13 mentioned above). In that case, as shown in FIG. 11, the navigation controller 6 collects a change in the tilt amount of the joystick 14, or a change in the rotational operation amount of the knob 15, or the like as hull acceleration request information (step S131). The fact that this change is larger than a predetermined threshold value denotes that there is a request to accelerate the hull 2 from the vessel operator (hereinafter, referred to as a "hull acceleration request"). If there is no hull acceleration request (step S132: NO), the navigation controller 6 sets the target value of the thrust F3 of the bow thruster 5 as being small (step S133). If there is a hull acceleration request (step S132: YES), the navigation controller 6 sets the target value of the thrust F3 of the bow thruster 5 as being large (step S134). While the small and large values of the bow-thruster target value may vary according to the vehicle 1 being directed, the small target value is a value less than the large target value. Thereafter, the navigation controller 6 drives both the outboard motor 4 and the bow thruster 5 so as to generate a thrust on the basis of a corresponding target value (step S4 mentioned above). Therefore, for example, when the vessel operator wants to veer the hull 2, the navigation controller 6 veers the hull 2 by means of a thrust F2 by a thrust R generated by each outboard motor 4 in response to the operation of the joystick 14 or of the knob 15 by the vessel operator as shown in FIG. 12. At this time, the navigation controller 6 controls the bow thruster 5 so as to generate the large thrust F3 (thrust F3 that has been set as a target value in step S134) by which its veering is hastened. Hence, a moment M that veers the hull 2 is swiftly generated, and therefore it becomes possible to perform a vessel operation having high responsibility. The navigation controller 6 may control the bow thruster 5 so as to generate the thrust F3 (thrust F3 that has been set as a target value in step S133) that prevents the veering of the hull 2. Hence, when a veering request (for example, to operate the joystick 14 or the knob 15) that is made by the vessel operator is no longer issued, it is possible to prevent the hull 2 from continuously veering under its own inertia. The thrust F3 that prevents the veering of the hull 2 may be a positive value following a direction in which the hull 2 veers, or may be a negative value opposite to the direction in which the hull 2 veers.

The bow thruster 5 becomes undrivable when the state value of the bow thruster 5 becomes a state value that is indicated when a fixed period of time (for example, four minutes as mentioned above) elapses after the bow thruster 5 starts being driven. In that case, the navigation controller 6 calculates a target value of a thrust that is to be generated by each outboard motor 4 that is successively driven (step S13 mentioned above), and drives each outboard motor 4 so as to generate a thrust on the basis of this target value (step S4 mentioned above). Hence, the outboard motor 4, instead of the bow thruster 5 that has been stopped, continuously generates a thrust, and therefore it is possible to successively veer the hull 2 in such away as to be desired by the vessel operator as shown in, for example, FIG. 13.

Figure 14:
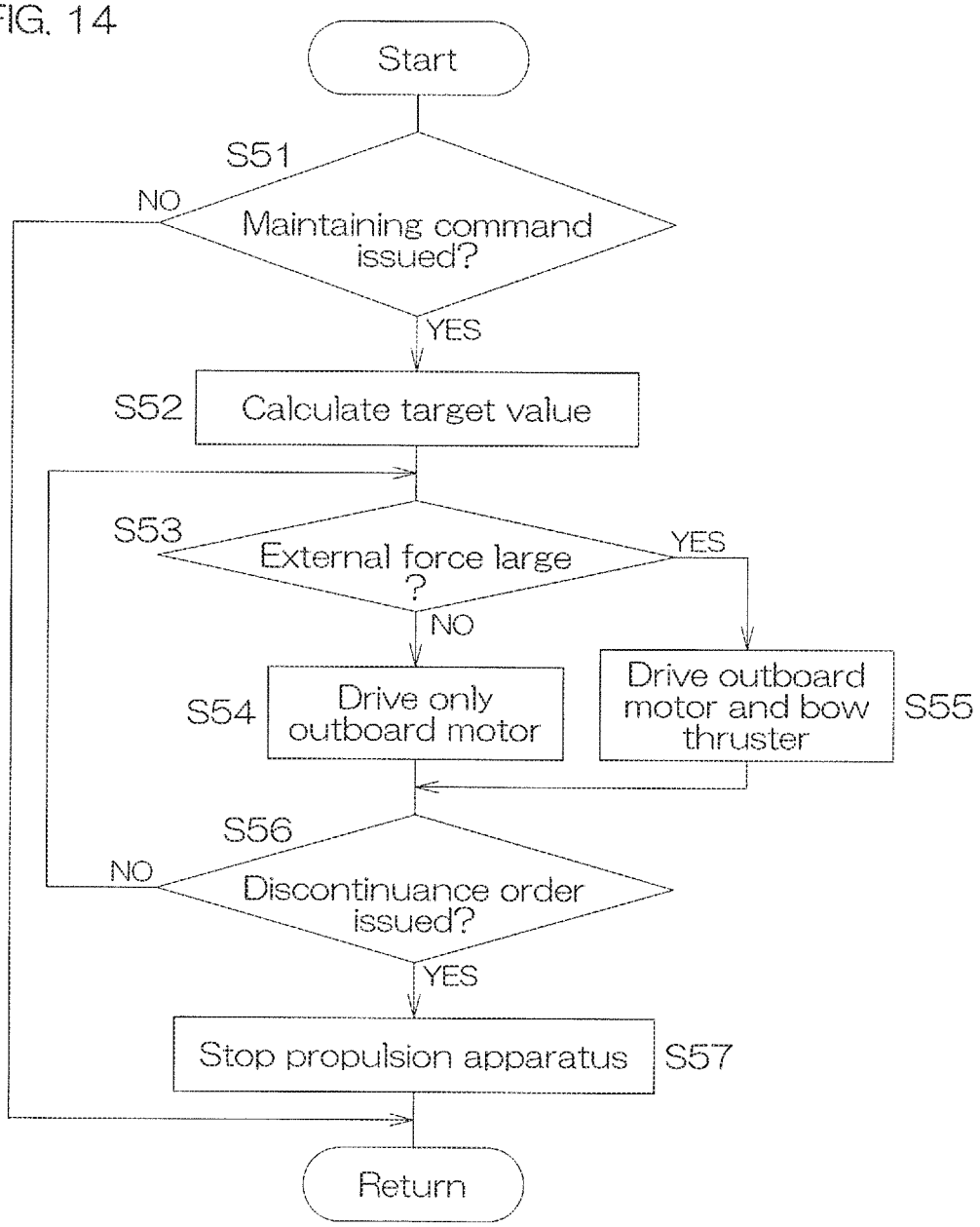
FIG. 14 is a flowchart to describe a vessel operation according to another pattern of the third example.

FIG. 14 is a flowchart to describe a vessel operation according to another pattern of the third example. When the vessel operator operates the heading maintaining button 68 or the fixed-point maintaining button 69, a maintenance command corresponding to its operation is input into the navigation controller 6. When the maintenance command is input (step S51: YES), the navigation controller 6 calculates a target value (step S52). In detail, based on a present-position signal of the vessel 1 generated by the position detector 61, the navigation controller 6 calculates a momentary amount of change of the position of the vessel 1, and, from this amount of change, the navigation controller 6 calculates an external force applied by waves acting on the vessel 1 or the like. Thereafter, the navigation controller 6 calculates a target value of a thrust that balances the calculated external force.

If the external force is smaller than a predetermined threshold value (step S53: NO), it is possible to fully maintain the heading or the position of the vessel 1 merely by the thrust of the outboard motor 4, and therefore the navigation controller 6 calculates a target value of a thrust that is to be generated by the outboard motor 4. Thereafter, the navigation controller 6 drives each outboard motor 4 so as to generate a thrust on the basis of this target value (step S54). Hence, only the outboard motor 4 is driven, and the heading or the position of the vessel 1 is maintained by its thrust. Therefore, it is possible to save the bow thruster 5.

If the external force is larger than a predetermined threshold value (step S53: YES), it is impossible to maintain the heading or the position of the vessel 1 only by the thrust of the outboard motor 4. Therefore, the navigation controller 6 calculates a target value of a thrust that is to be generated by each of the outboard motor 4 and the bow thruster 5. Thereafter, the navigation controller 6 drives both the outboard motor 4 and the bow thruster 5 so as to generate a thrust on the basis of a corresponding target value (step S55). Hence, the heading or the position of the vessel 1 is maintained by the thrust generated by each of the outboard motor 4 and the bow thruster 5.

Therefore, when the veering of the hull 2 is prevented by the thrust generated by the outboard motor 4, the navigation controller 6 controls the bow thruster 5 so as to generate a thrust that assists preventing the veering of the hull 2 if the maintenance command in step S51 is input by the heading maintaining button 68 (step S55). On the other hand, when the position of the hull 2 is maintained by the thrust generated by the outboard motor 4, the navigation controller 6 controls the bow thruster 5 so as to generate a thrust that assists maintenance the position of the hull 2 if the maintenance command in step S51 is input by the fixed-point maintaining button 69 (step S55).

Thereafter, for example, when the vessel operator again operates the heading maintaining button 68 or the fixed-point maintaining button 69, a discontinuance order to discontinue the heading maintaining or the fixed-point maintenance is input into the navigation controller 6. When the discontinuance order is input (step S56: YES), the navigation controller 6 stops the propulsion apparatus (step S57), and the input of the following maintenance command is awaited (step S51).

Figure 15:
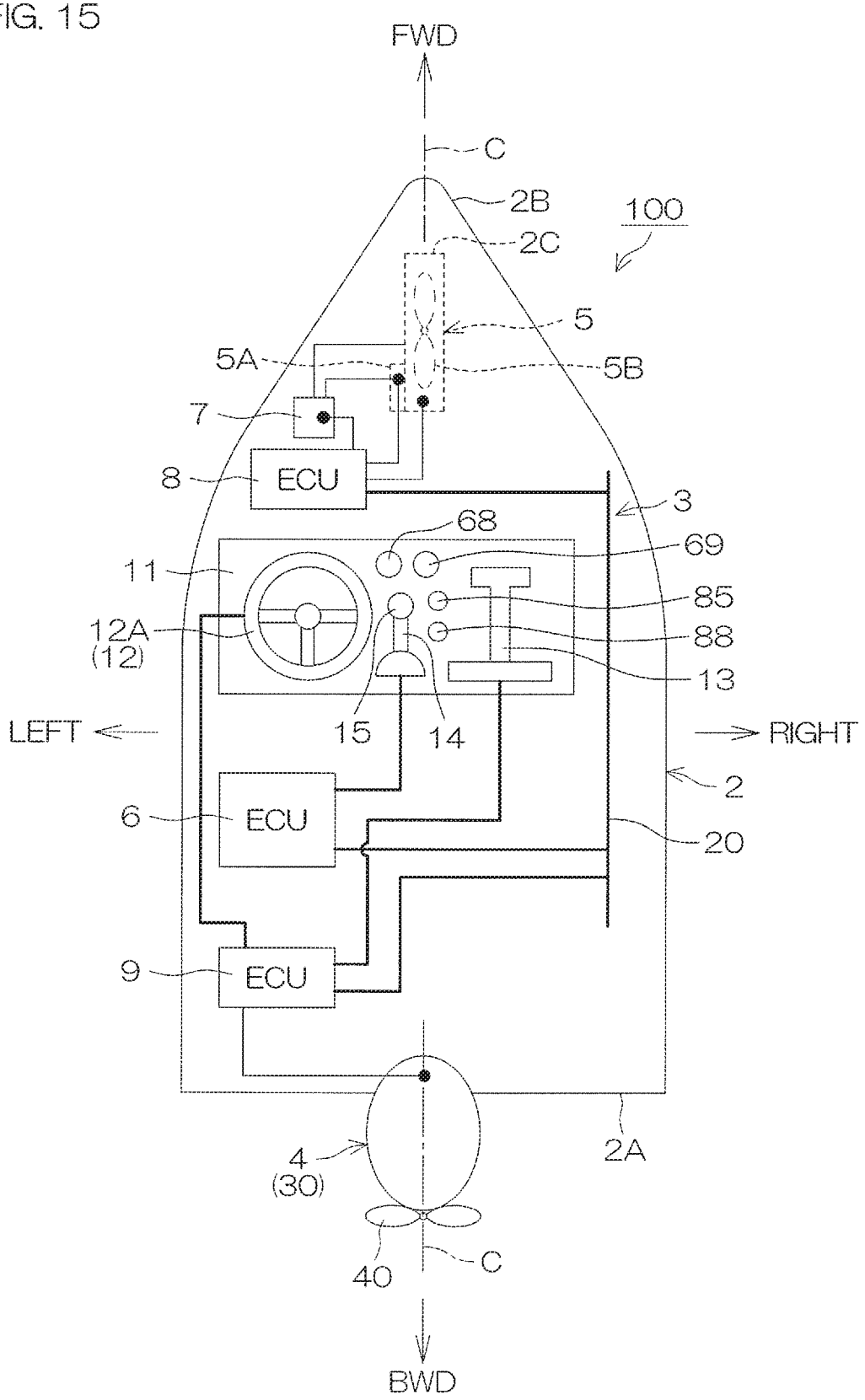
FIG. 15 is a conceptual diagram to describe an arrangement of a vessel according to another embodiment of the present invention.

FIG. 15 is a conceptual diagram to describe an arrangement of a vessel 100 according to another embodiment of the present invention. In the following description, the same reference numeral is given to a component that is functionally equivalent to each component described with respect to the aforementioned vessel 1, and a detailed description of this component is omitted. Although the vessel 1 is provided with the left-right pair of outboard motors 4, the vessel 100 is provided with only one outboard motor 4. In other words, the outboard motor 4 of the vessel 100 is only one propulsion apparatus and is different from the bow thruster 5, and both the outboard motor 4 and the bow thruster 5 are mounted on the hull 2. In the vessel 100, this outboard motor 4 is attached to a central portion in the right-left direction in the stern 2A of the hull 2. Since this embodiment includes only one outboard motor 4, the throttle operation portion 13 of the vessel 100 is provided with only one throttle lever, and only one outboard motor ECU 9 is mounted.

Figure 16:
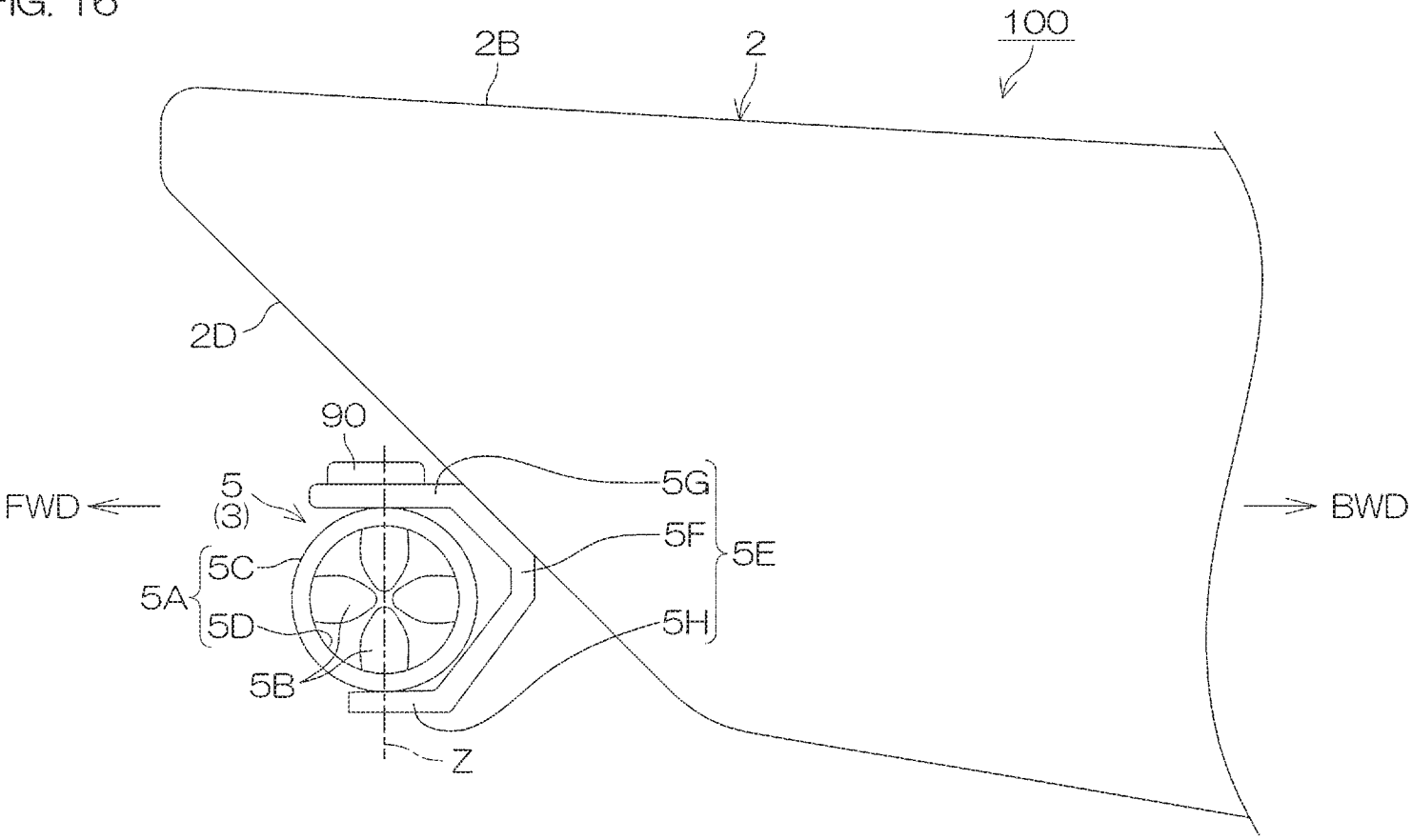
FIG. 16 is a side view of a bow part of a vessel according to another embodiment of the present invention.

FIG. 16 is a side view of a bow part of the vessel 100. The electric motor 5A of the bow thruster 5 may be formed of the aforementioned AC motor. The electric motor 5A formed of an AC motor has the advantage that the continuous driving time is longer, the advantage that a rise in temperature resulting from driving is smaller, the advantage that the number of rotations is more easily controlled, etc., than in a case in which the electric motor 5A is formed of a DC motor. The electric motor 5A formed of an AC motor is a radial gap motor that has, for example, a cylindrical duct 5C and an annular rim 5D rotatably supported by an inner periphery of the duct 5C. A plurality of blades arranged in a circumferential direction in an inner peripheral surface of the rim 5D compose the aforementioned propeller 5B. When the electric motor 5A is actuated, the rim 5D is rotationally driven together with the propeller 5B, and, as a result, the aforementioned thrust F3 is generated.

The bow thruster 5 additionally includes a bracket 5E that supports the duct 5C. The bracket 5E has, for example, a fixed portion 5F fixed to a keel 2D of the hull 2, an upper portion 5G extending forwardly from an upper end of the fixed portion 5F, and a lower portion 5H extending forwardly from a lower end of the fixed portion 5F. The duct 5C is placed between the upper portion 5G and the lower portion 5H, and is connected to these portions 5G and 5H. In this state, the propeller 5B, the rim 5D, and the duct 5C are rotatable around a rotational axis Z in the up-down direction. The bow thruster 5 additionally includes a bow turning unit 90 that rotates the propeller 5B, the rim 5D, and the duct 5C together. The bow turning unit 90 is formed of, for example, a servo motor, and is actuated by receiving electric power of, for example, the battery 7. A battery that supplies electric power to the bow turning unit 90 may be provided separately from the battery 7. The bow turning unit 90 changes a direction (hereinafter, referred to as a "turning angle θ") of the thrust F3 with respect to the center line C of the hull 2 by rotating the propeller 5B.

Figure 17:
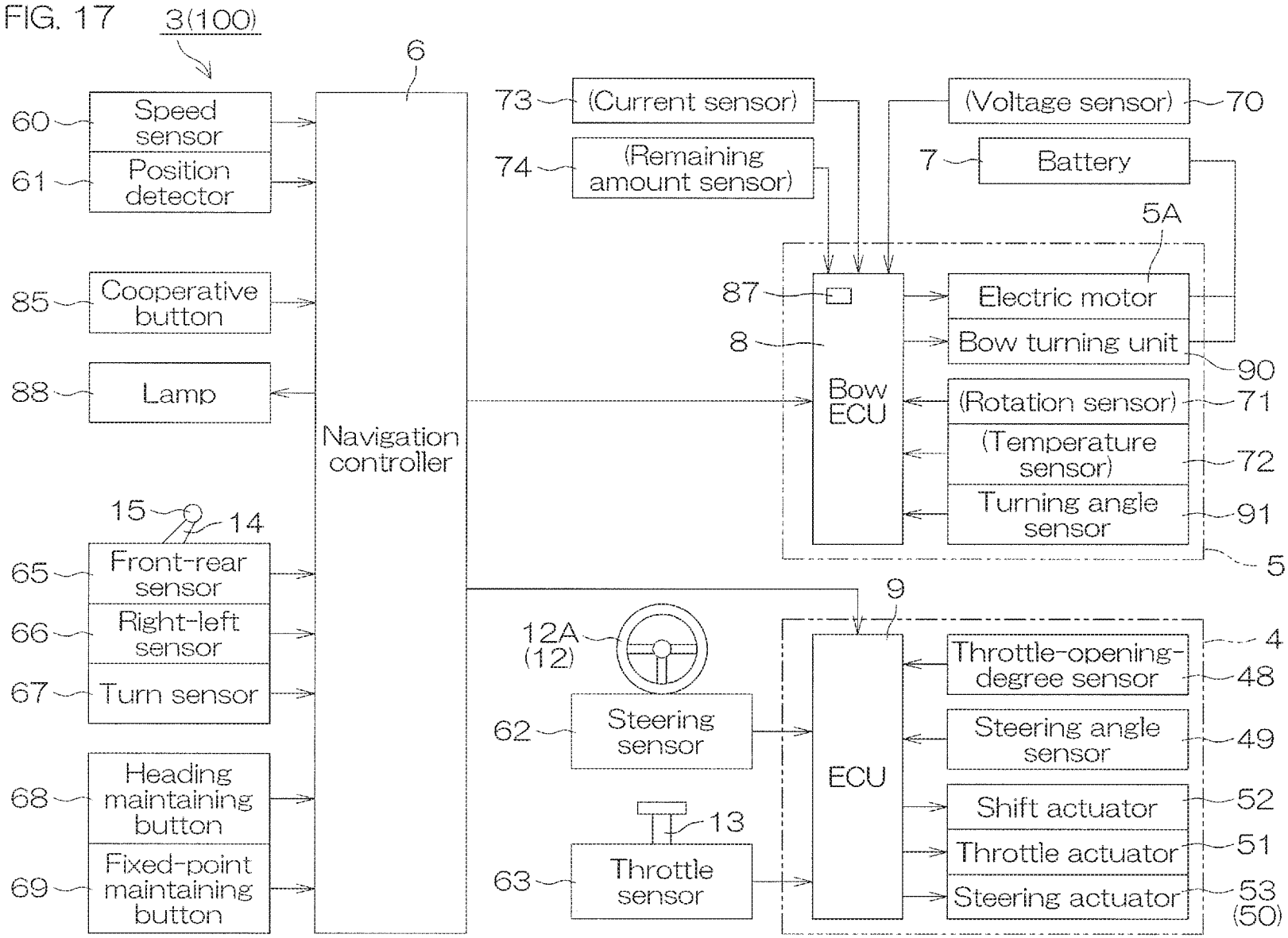
FIG. 17 is a block diagram showing an electrical configuration of a vessel propulsion system included in a vessel according to another embodiment of the present invention.

FIG. 17 is a block diagram showing an electrical configuration of a propulsion system 3 included in the vessel 100. A description will be hereinafter given of an electrical configuration different from the electrical configuration of the propulsion system 3 (see FIG. 3) included in the vessel 1. In the propulsion system 3 included in the vessel 100, only one throttle sensor 63 is mounted correspondingly to the fact that the throttle operation portion 13 is provided with only one throttle lever. The bow turning unit 90 is controlled by the bow ECU 8. The bow turning unit 90 is provided with a turning angle sensor 91 that detects a turning angle θ. The turning angle sensor 91 consists of, for example, a potentiometer. An output signal of a turning angle θ detected by the turning angle sensor 91 is input into the bow ECU 8.

Figure 18:
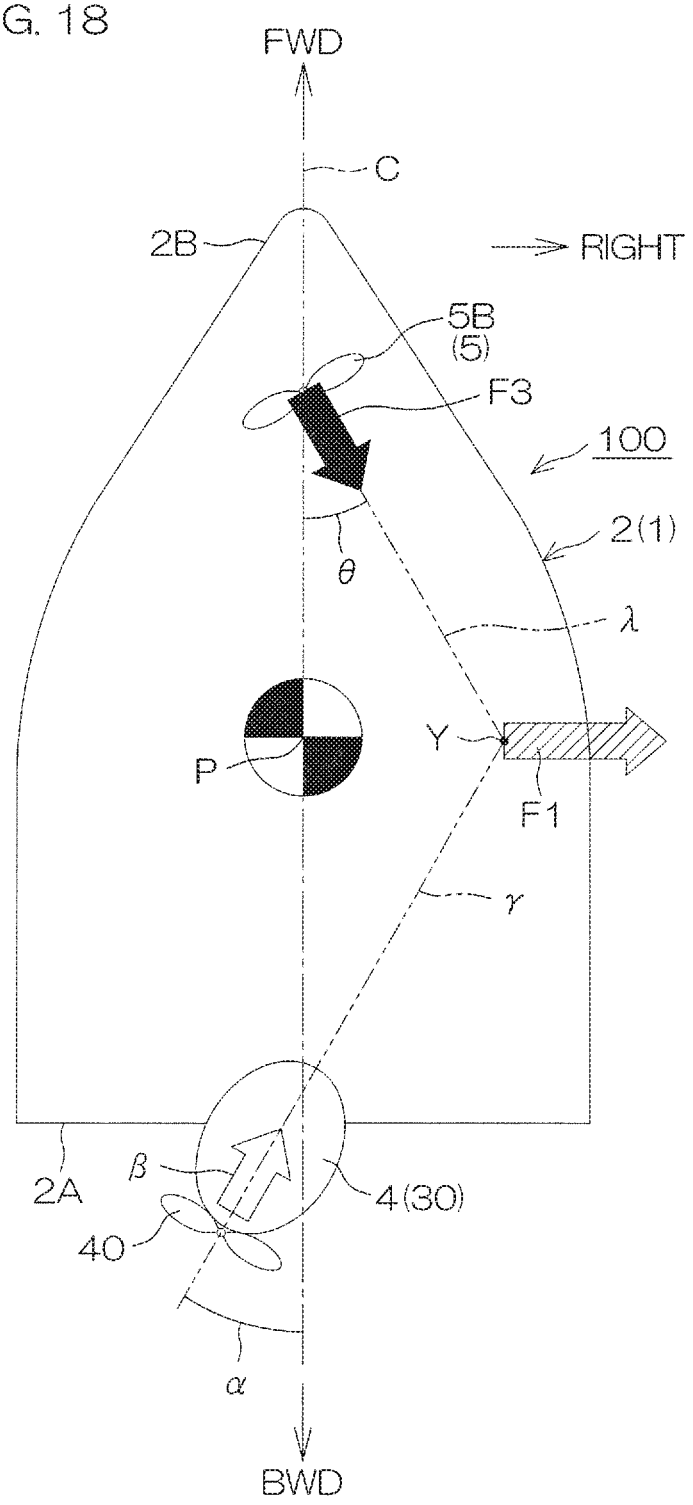
FIG. 18 is a view to describe a vessel behavior by a vessel operation according to a fourth example.

In the vessel 100 provided with only one outboard motor 4, it is impossible to allow the thrust of the outboard motor 4 to act only leftwardly or only rightwardly with respect to the hull 2, and therefore it is impossible to allow the hull 2 to make a leftward or rightward translational movement only by the thrust of the outboard motor 4. However, it is possible to allow the hull 2 to make a leftward or rightward translational movement by means of a cooperative vessel operation by both the outboard motor 4 and the bow thruster 5. A description will be hereinafter given of a vessel operation according to a fourth example carried out to allow the hull 2 of the vessel 100, for example, to make a rightward translational movement. FIG. 18 is a view to describe a behavior of the vessel 100 by a vessel operation according to the fourth example.

The vessel 100 is operated according to the flowchart of FIG. 4 in the same way as the vessel 1. Therefore, when the vessel operator rightwardly tilts the joystick 14, a signal that indicates a rightward tilt amount of the joystick 14 detected by the right-left sensor 66 is input into the navigation controller 6 as a translational movement command (step S5: YES). If there is a cooperation request at this time (step S7: YES), the navigation controller 6 calculates a hull target value (step S10). In detail, referring to FIG. 18, it is possible to allow the hull 2 to make a rightward translational movement at a speed desired by the vessel operator if a rightward thrust F1 according to the tilt amount of the joystick 14 acts on the hull 2. To do so, a resultant force of both the thrust β of the outboard motor 4 and the thrust F3 of the bow thruster 5 is required to become the thrust F1. Additionally, the magnitude of the thrust β and the magnitude of the thrust F3 are required to be set so that a moment around the rotational center P by the thrust β and a moment around the rotational center P by the thrust F3 cancel each other.

The navigation controller 6 sets a target value (hull target value) of the thrust F1 in accordance with the tilt amount of the joystick 14 (step S10). Thereafter, the navigation controller 6 calculates a target value of the thrust R of the outboard motor 4 and a target value of the thrust F3 of the bow thruster 5 that are required to allow the thrust F1 to become the target value on the basis of the present maximum thrust of the bow thruster 5 or the like (step S13). In detail, the navigation controller 6 calculates a target value of the thrust β and a target value of the steering angle α with respect to the outboard motor 4, and calculates a target value of the thrust F3 and a target value of the turning angle θ with respect to the bow thruster 5. The subsequent process is performed in the same way as above.

When the hull 2 is allowed to make a rightward translational movement, the navigation controller 6 changes the steering angle α and the turning angle θ so that a crossing position Y between the line of action γ of the thrust β and the line of action 2 of the thrust F3 coincides with the rotational center P in the front-rear direction and so that the crossing position Y is placed at a more rightward position than the rotational center P in step S4. In detail, the navigation controller 6 leftwardly rotates the propulsion unit 30 of the outboard motor 4 so that the absolute value of the steering angle α and the absolute value of the turning angle θ become equal to each other, and rotates the propeller 5B of the bow thruster 5 in a clockwise direction or in a counter-clockwise direction in a plan view. Thereafter, the navigation controller 6 allows the outboard motor 4 to generate a forward thrust β, and allows the bow thruster 5 to generate a backward thrust F3.

Hence, a resultant force of both the thrust β and the thrust F3 becomes the rightward thrust F1, and acts on the hull 2, and therefore the hull 2 makes a rightward translational movement at a speed desired by the vessel operator who has handled the joystick 14. As thus described, the navigation controller 6 controls the bow turning unit 90 so that the hull 2 moves translationally in accordance with at least one (both in the description given here) of the magnitude and the direction of the thrust β of the outboard motor 4.

As described above, according to the first to fourth examples of the present embodiment, in accordance with a state of at least one of the outboard motor 4 and the bow thruster 5, the navigation controller 6 controls at least one other of the outboard motor 4 and the bow thruster 5.

According to this arrangement, it is possible to allow the bow thruster 5 and the outboard motor 4 to cooperate with each other. Therefore, it is possible to bring one of the bow thruster 5 and the outboard motor 4 into operation so as to assist the other one even if the bow thruster 5 and the outboard motor 4 have mutually different thrust characteristics. This enables the propulsion system 3 to swiftly generate a thrust having a magnitude and a direction both of which are desired by the vessel operator and to continuously generate the thrust during a period of time desired by the vessel operator. Therefore, in the vessels 1 and 100 on which the propulsion system 3 is mounted, it is possible to bring a hull behavior close to the vessel operator's intentions. Additionally, cooperation between the outboard motor 4 and the bow thruster 5 makes it possible to generate a thrust larger than a thrust that can be generated only by the outboard motor 4.

In the first example, the navigation controller 6 controls a thrust generated by the outboard motor 4 in accordance with a state of the bow thruster 5. According to this arrangement, it is possible to perform control so as to generate a thrust so that the outboard motor 4 assists the bow thruster 5. That enables the propulsion system 3 to generate a thrust desired by the vessel operator even if the state of the bow thruster 5 changes. Therefore, it is possible to bring a hull behavior close to the vessel operator's intentions.

In the first example, the navigation controller 6 controls the turning unit 50 in accordance with a state of the bow thruster 5, and changes the direction of a thrust of the outboard motor 4. According to this arrangement, it is possible to change the direction of the thrust of the outboard motor 4 so as to assist the bow thruster 5 by allowing the navigation controller 6 to control the turning unit 50. This enables the propulsion system 3 to generate a thrust having a direction desired by the vessel operator even if the state of the bow thruster 5 changes. Therefore, it is possible to bring a hull behavior close to the vessel operator's intentions.

In the first example, the navigation controller 6 obtains a state value that affects thrust characteristics of the bow thruster 5, and controls the outboard motor 4 in accordance with the state value. In the present embodiment, this state value is the temperature of the electric motor 5A or information that can estimate the remaining capacity of the battery 7 (voltage of the battery 7, electric current of the battery 7, and remaining amount of the battery 7, or driving time of the electric motor 5A). According to this arrangement, the outboard motor 4 is capable of performing control so as to generate a thrust according to the state value of the bow thruster 5 so as to assist the bow thruster 5. This enables the propulsion system 3 to generate a thrust desired by the vessel operator even if the state value of the bow thruster 5 changes in accordance with a change in the state of the bow thruster 5. Therefore, it is possible to bring a hull behavior close to the vessel operator's intentions.

In the second example, the navigation controller 6 controls a thrust generated by the bow thruster 5 in accordance with the state of the outboard motor 4. According to this arrangement, a thrust is generated so that the bow thruster 5 assists the outboard motor 4, and, as a result, it is possible for the propulsion system 3 to generate a thrust desired by the vessel operator even if the state of the outboard motor 4 changes. Therefore, it is possible to bring a hull behavior close to the vessel operator's intentions.

In the second example, the navigation controller 6 controls the outboard motor 4 so as to generate a thrust having a fixed magnitude, and controls the thrust of the bow thruster 5 in accordance with a command given by the joystick 14 and in accordance with a thrust having a fixed magnitude generated by the outboard motor 4.

According to this arrangement, when the vessel operator operates the joystick 14, the bow thruster 5 generates a thrust so as to assist the outboard motor 4 controlled to generate the thrust having the fixed magnitude. This enables the propulsion system 3 to generate a thrust having a magnitude and a direction both of which are desired by the vessel operator who handles the joystick 14. Therefore, it is possible to bring a hull behavior close to the vessel operator's intentions.

In the third example, when the hull 2 is veered by a thrust generated by the outboard motor 4, the navigation controller 6 controls the bow thruster 5 so as to generate a thrust by which its veering is hastened or is prevented. According to this arrangement, the propulsion system 3 allows the hull 2 to generate a moment desired by the vessel operator by means of cooperation between the outboard motor 4 and the bow thruster 5, and, as a result, it is possible to bring a hull behavior in veering close to the vessel operator's intentions.

In the third example, when the veering of the hull 2 is prevented by a thrust generated by the outboard motor 4, the navigation controller 6 controls the bow thruster 5 so as to generate a thrust that assists its veering prevention. According to this arrangement, the propulsion system 3 reduces the moment of the hull 2 according to the desire of the vessel operator by means of cooperation between the outboard motor 4 and the bow thruster 5, and, as a result, it is possible to bring a hull behavior, in preventing veering, close to the vessel operator's intentions.

In the third example, when the position of the hull 2 is maintained by a thrust generated by the outboard motor 4, the navigation controller 6 controls the bow thruster 5 so as to generate a thrust that assists its position maintenance. According to this arrangement, both a thrust generated by the outboard motor 4 and a thrust generated by the bow thruster 5 enable the propulsion system 3 to bring a hull behavior, in position maintenance, close to the vessel operator's intentions.

In the first to third examples, the bow thruster 5 is designed to be disposed in a state of applying a thrust in a fixed direction to the hull 2. According to this arrangement, cooperation is performed between the bow thruster 5 disposed to apply a thrust in the fixed direction to the hull 2 and the outboard motor 4, thus enabling the propulsion system 3 to generate a thrust desired by the vessel operator. Therefore, it is possible to bring a hull behavior close to the vessel operator's intentions.

In the first to third examples, the propulsion system 3 includes a plurality of outboard motors 4, and the navigation controller 6 controls the bow thruster 5 and the plurality of outboard motors 4 so that the hull 2 moves translationally in directions including a right-left direction component. According to this arrangement, the navigation controller 6 allows the bow thruster 5 and the plurality of outboard motors 4 to cooperate with each other, thus enabling the propulsion system 3 to generate a thrust by which the hull 2 is translationally moved according to the desire of the vessel operator. Therefore, it is possible to bring a hull behavior close to the vessel operator's intentions.

In the first to third examples, the plurality of outboard motors 4 are designed so that the crossing position X between the lines of action γ of a thrust generated by each of the plurality of outboard motors 4 is variable within a range W including a more rearward position than the rotational center P of the hull 2.

According to this arrangement, it is possible to generate the thrust of the bow thruster 5 at a more forward position than the rotational center P of the hull 2 and allow a resultant force of thrusts of the plurality of outboard motors 4 to act at a more rearward position than the rotational center P of the hull 2. At this time, an outboard-motor target value or a bow-thruster target value is determined so that a moment by the thrust of the bow thruster 5 and a moment by the resultant force cancel each other, and therefore it is possible to prevent the veering of the hull 2. As a result, it is possible to generate a thrust by which the hull 2 is translationally moved in a direction desired by the vessel operator. Therefore, it is possible to bring a hull behavior close to the vessel operator's intentions.

In the fourth example, the bow thruster 5 includes the bow turning unit 90 that changes the direction of a thrust with respect to the hull 2. The navigation controller 6 controls the bow turning unit 90 in accordance with at least one of the magnitude and the direction of the thrust of the outboard motor 4 so that the hull 2 moves translationally in a direction including a right-left direction component.

According to this arrangement, the navigation controller 6 controls the bow turning unit 90 in accordance with at least one of the magnitude and the direction of the thrust of the outboard motor 4, and changes the direction of the thrust of the bow thruster 5. As thus described, the direction of the thrust is changed so that the bow thruster 5 assists the outboard motor 4, thus enabling the propulsion system 3 to generate a thrust by which the hull 2 is translationally moved according to the desire of the vessel operator. Therefore, it is possible to bring a hull behavior close to the vessel operator's intentions.

In the fourth example, the outboard motor 4 is only one propulsion apparatus mounted on the hull 2 besides the bow thruster 5. According to this arrangement, cooperation between the bow thruster 5 and the only one outboard motor 4 enables the propulsion system 3 to generate a thrust desired by the vessel operator. Therefore, it is possible to bring a hull behavior close to the vessel operator's intentions.

For example, in the first example, the navigation controller 6 imparts the drivable time of the bow thruster 5, and issues a warning when the drivable time becomes shorter (step S14). According to this arrangement, it is possible to avoid the occurrence of a bow-thruster undrivable state at an unintended timing for the vessel operator even when the continuous driving of the bow thruster 5 is limited to a fixed time.

In the first to fourth examples, the outboard motor 4 is designed to allow a thrust to act on the hull 2 at a more rearward position than the rotational center P of the hull 2. According to this arrangement, it is possible to allow the thrust of the bow thruster 5 to act on the hull 2 at a more forward position than the rotational center P of the hull 2, and it is possible to allow the thrust of the outboard motor 4 to act on the hull 2 at a more rearward position than the rotational center P of the hull 2. At this time, each target value is set so that a moment by the thrust of the bow thruster 5 and a moment by the thrust of the outboard motor 4 cancel each other, and therefore it is possible to prevent the veering of the hull 2. This enables the propulsion system 3 to generate a thrust by which the hull 2 is translationally moved in a direction desired by the vessel operator. Therefore, it is possible to bring a hull behavior close to the vessel operator's intentions.

Although preferred embodiments of the present invention have been described above, the present invention is not restricted to the contents of these embodiments and various modifications are possible within the scope of the present invention.

For example, with respect to the translational movement of the hull 2, a rightward translational movement has been described, and yet this lateral movement is merely one example, and the cooperative vessel operation is applicable to a translational movement in all directions including a right-left direction component, such as a diagonal movement. As a matter of course, the cooperative vessel operation is also applicable to movements (for example, turning during ordinary traveling) other than the translational movement.

Additionally, in the second example mentioned above, the thrust of the bow thruster 5 is adjusted to be reduced in accordance with the thrust of the outboard motor 4 when the maximum thrust of the bow thruster 5 is excessive. For example, at the initial setting of the propulsion system 3, the maximum thrust of the bow thruster 5 may be changed so as to become smaller than at the beginning when a cooperative vessel operation is performed.

Additionally, an inboard/outboard motor or a waterjet drive may be used instead of the outboard motor 4. In the inboard/outboard motor, a prime mover is placed inside the vessel, and a drive unit that includes a thrust generating member and a steering mechanism is placed outside the vessel. The inboard motor has a form in which both a prime mover and a drive unit are built into the hull and in which a propeller shaft extends from the drive unit toward the outside of the vessel. In this case, the steering mechanism is separately disposed. The waterjet drive obtains a thrust by accelerating water sucked from the vessel bottom by use of a pump and by jetting the water from a jet nozzle at the stern. In this case, the steering mechanism is composed of a jet nozzle and a mechanism that rotates this jet nozzle along a horizontal plane.

Various features described above may be appropriately combined together.

Also, features of two or more of the various embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion system, comprising:

a bow thruster located at a bow of a hull;

a propulsion apparatus located at a position of the hull and provided separately from the bow thruster; and a cooperative control unit that controls at least one of the bow thruster and the propulsion apparatus in accordance with a state of at least one other of the bow thruster and the propulsion apparatus, wherein the bow thruster includes an electric motor and a propeller driven by the electric motor, the cooperative control unit obtains a state value that affects thrust characteristics of the bow thruster, and controls the propulsion apparatus in accordance with the state value, and the state value includes a temperature of the electric motor.

2. The vessel propulsion system according to claim 1, wherein the cooperative control unit controls a thrust generated by the propulsion apparatus in accordance with a state of the bow thruster.

3. The vessel propulsion system according to claim 1, wherein the propulsion apparatus includes a turning unit that changes a direction of the thrust with respect to the hull, and the cooperative control unit controls the turning unit in accordance with a state of the bow thruster.

4. The vessel propulsion system according to claim 1, wherein the electric motor is driven by electric power from a battery mounted on the hull, and the state value further includes at least one of a voltage of the battery, an electric current of the battery, and a remaining charge amount of the battery.

5. A vessel propulsion system, comprising:

a bow thruster located at a bow of a hull;

a propulsion apparatus located at a position of the hull and provided separately from the bow thruster; and a cooperative control unit that controls at least one of the bow thruster and the propulsion apparatus in accordance with a state of at least one other of the bow thruster and the propulsion apparatus, wherein the bow thruster includes an electric motor that is driven by electric power from a battery mounted on the hull and a propeller that is driven by the electric motor, the cooperative control unit obtains a state value that affects thrust characteristics of the bow thruster, and controls the propulsion apparatus in accordance with the state value, and the state value includes a driving time of the electric motor.

6. The vessel propulsion system according to claim 1, wherein the cooperative control unit controls a thrust generated by the bow thruster in accordance with a state of the propulsion apparatus.

7. The vessel propulsion system according to claim 6, further comprising an operation element that is operated by a vessel operator in order to command a magnitude and a direction of a thrust to be applied to the hull, wherein the cooperative control unit controls the propulsion apparatus to generate a thrust having a fixed magnitude, and controls the thrust of the bow thruster in accordance with a command indicated by the operation element and in accordance with the thrust having the fixed magnitude generated by the propulsion apparatus.

8. The vessel propulsion system according to claim 1, wherein the bow thruster is positioned to apply a thrust having a fixed direction to the hull.

9. The vessel propulsion system according to claim 1, wherein the propulsion apparatus includes a plurality of the propulsion apparatuses, and wherein the cooperative control unit controls the bow thruster and the plurality of propulsion apparatuses so that the hull moves translationally in a direction including a right-left direction component.

10. The vessel propulsion system according to claim 9, wherein the plurality of propulsion apparatuses are designed so that a crossing position between lines of action of thrusts generated by each respective propulsion apparatus of the plurality of propulsion apparatuses is variable within a range including a more rearward position than a rotational center of the hull.

11. The vessel propulsion system according to claim 1, wherein the bow thruster includes a bow turning unit that changes a direction of a thrust with respect to the hull, and the cooperative control unit controls the bow turning unit in accordance with at least one of a magnitude and a direction of a thrust of the propulsion apparatus so that the hull moves translationally in a direction including a right-left direction component.

12. The vessel propulsion system according to claim 11, wherein the propulsion apparatus is only one propulsion apparatus and is different from the bow thruster, wherein the propulsion apparatus and the bow thruster are mounted on the hull.

13. The vessel propulsion system according to claim 1, wherein, when the hull is veered by a thrust generated by the propulsion apparatus, the cooperative control unit controls the bow thruster so as to generate a thrust by which a veer of the hull is hastened or prevented.

14. The vessel propulsion system according to claim 1, wherein, when a veer of the hull is prevented by a thrust generated by the propulsion apparatus, the cooperative control unit controls the bow thruster so as to generate a thrust by which prevention of the veer of the hull is assisted.

15. The vessel propulsion system according to claim 1, wherein, when a position of the hull is maintained by a thrust generated by the propulsion apparatus, the cooperative control unit controls the bow thruster so as to generate a thrust by which maintenance of the position of the hull is assisted.

16. A vessel propulsion system, comprising:

a bow thruster located at a bow of a hull;

a propulsion apparatus located at a position of the hull and provided separately from the bow thruster; and a cooperative control unit that controls at least one of the bow thruster and the propulsion apparatus in accordance with a state of at least one other of the bow thruster and the propulsion apparatus, wherein the cooperative control unit measures a drivable time of the bow thruster and issues a warning when the drivable time falls below a predetermined threshold.

17. The vessel propulsion system according to claim 1, wherein the propulsion apparatus generates a thrust that acts on the hull at a more rearward position than a rotational center of the hull.

18. A vessel comprising:

a hull; and the vessel propulsion system according to claim 1 mounted on the hull.

* * * * *